US006550700B1

(12) United States Patent
Griebat et al.

(10) Patent No.: US 6,550,700 B1
(45) Date of Patent: Apr. 22, 2003

(54) GRANULAR MATERIAL TEST MILLING PROCESSES

(75) Inventors: John Griebat, Atchison, KS (US); David Strief, Palo, IA (US)

(73) Assignee: The Quaker Oats Company, Chicago, IL (US)

( * ) Notice: Subject to any disclaimer, the term of this patent is extended or adjusted under 35 U.S.C. 154(b) by 0 days.

(21) Appl. No.: 09/722,150

(22) Filed: Nov. 27, 2000

(51) Int. Cl.[7] ..... B02C 25/00
(52) U.S. Cl. ..... 241/30; 241/301
(58) Field of Search ..... 241/101.2, 30, 241/33, 301, 6–11

(56) References Cited

U.S. PATENT DOCUMENTS

| | | | | |
|---|---|---|---|---|
| 1,117,963 | A | | 11/1914 | Pollock |
| 2,392,365 | A | | 1/1946 | Carter |
| 2,464,212 | A | | 3/1949 | Carter et al. |
| 3,399,839 | A | | 9/1968 | Anderson et al. |
| 3,606,918 | A | | 9/1971 | Sian |
| 4,133,899 | A | | 1/1979 | Wolffing et al. |
| 4,181,748 | A | | 1/1980 | Chwalek et al. |
| 4,189,503 | A | | 2/1980 | Giguere |
| 4,301,183 | A | | 11/1981 | Giguere |
| 4,365,546 | A | | 12/1982 | Giguere |
| 5,005,774 | A | * | 4/1991 | Martin et al. ..... 241/101.2 |
| 5,198,035 | A | | 3/1993 | Lee et al. |
| 5,250,313 | A | | 10/1993 | Giguere |
| RE35,202 | E | | 4/1996 | Baltensperger et al. |

* cited by examiner

*Primary Examiner*—Mark Rosenbaum
(74) *Attorney, Agent, or Firm*—Glenn Johnson; Douglas J. Stilwell

(57) ABSTRACT

The present invention is a test milling method to determine the suitability of a grain for use in the derivation of desired end products. A full scale mill is simulated through a bench scale application wherein only a small portion of grain is required to conduct the test in contrast to testing protocols which employ full scale equipment. By utilizing the small scale simulations, hybrid varieties may be tested for total grit extraction and total yield well in advance of the many seasons that it takes to develop market quantities of a hybrid. The invention also relates to a method for determining which items of data collected are needed to accurately predict the total yield and grit extraction % and subsequently applying these limited data points in a shortened simulation to reduce the number of steps required in the test protocol. Data obtained from such tests may be used to direct hybrid research and select the best hybrids and shipments for the desired milling process.

15 Claims, 21 Drawing Sheets

Multiple Regression Analysis

Dependent Variable: TotGrit %

| Parameter | Estimate | Standard Error | T Statistic | P-Value |
|---|---|---|---|---|
| CONSTANT | 6.12117 | .06399 | 1.5062 | 0.1376 |
| B1p46 | -0.298715 | 0.0624725 | -4.78155 | 0.0000 |
| B1p10 | 0.13029 | 0.0182873 | 7.12464 | 0.0000 |
| B1p24 | 0.144905 | 0.0248371 | 5.83422 | 0.0000 |
| B1p46 | -0.0960314 | 0.0388141 | -2.47414 | 0.0164 |
| B2p10 | -0.108827 | 0.0184934 | -5.88463 | 0.0000 |
| B2p14 | -0.0735187 | 0.0329308 | -2.23252 | 0.0296 |
| B2p46 | -0.435525 | 0.16663 | -2.61373 | 0.0115 |
| Brkg% | 0.0117753 | 0.0039648 | 2.96997 | 0.0044 |
| HGp14 | 0.0104458 | 0.00270662 | 3.85937 | 0.0003 |

Analysis of Variance

| Source | Sum of Squares | Df | Mean Square | F-Ratio | P-Value |
|---|---|---|---|---|---|
| Model | 1049.26 | 9 | 116.584 | 104.57 | 0.0000 |
| Residual | 62.4343 | 56 | 1.1149 | | |
| Total (Corr.) | 1111.69 | 65 | | | |

R-squared = 94.3838 percent
R-squared (adjusted for d.f.) = 93.4812 percent
Standard Error of Est. = 1.05589
Mean absolute error = 0.680076
Durbin-Watson statistic = 1.69251

Stepwise regression

FIG. 6

Method: backward selection
F-to-enter: 4.0
F-to-remove:4.0

Final model selected

The StatAdvisor

The output sows the results of fitting a multiple linear regression model to describe the relationship between TotGrit % and 16 independent variables. The equation of the fitted model is:

TotGrit % = 6.12117 – 0.298715*B1m46 + 0.13029*B1p10 + 0.44905*B1p24 + 0.096031*B1p46 – 0.08827*Bp10 – 0.0735187*B2p14 – 0.435525*B2p46 + 0.0117753*Brkg% + 0.0104458*HGp14.

Since the P-value in the ANOVA table is less than 0.01, there is a statistically significant relationship between the variables at the 99% confidence level.

The R-Squared statistic indicates that the model as fitted explains 94.3838% of the variability in TotGrit %. The adjusted R-squared statistic, which is more suitable for comparing models with different numbers of independent variables, is 93.4812%. The standard error of the estimate shows the standard deviation of the residuals to be 1.05589. This value can be used to construct prediction limits for new observations by selecting the Reports option from the text menu. The mean absolute error (ME) of 0.680076 is the average value of the residuals. The Durbin-Watson (DW) statistic tests the residuals to determine if there is any significant correlation based on the order in which they occur in your data file. Since the DW value is greater than 1.4, there is probably not any serious autocorrelation in the residuals.

In determining whether the model can be simplified, notice that the highest P-value on the independent variables is 0.0296, belonging to B2p14. Since the P-value is less than 0.05, that term is statistically significant at the 95% confidence level. Consequently, you probably don't want to remove any variables from the model.

Multiple Regression Analysis

Dependent Variable: totprod

| Parameter | Estimate | Standard Error | T Statistic | P-Value |
|---|---|---|---|---|
| CONSTANT | -704.372 | 163.896 | -4.29768 | 0.0001 |
| B1p10 | 1.7573 | 0.179091 | 9.81233 | 0.0000 |
| B1p14 | 1.30584 | 0.236326 | 5.52557 | 0.0000 |
| B1p24 | 2.60447 | 0.406033 | 6.41444 | 0.0000 |
| B1p6 | 0.765518 | 0.175393 | 4.3646 | 0.001 |
| B2m46 | 3.82614 | 0.962658 | 3.97456 | 0.002 |
| Brkg% | 0.109253 | 0.0471985 | 2.31475 | 0.0243 |
| HGm14 | 1.08264 | 0.320126 | 3.38191 | 0.0013 |
| Hbp3 | 0.939389 | 0.287851 | 3.26346 | 0.0019 |

Analysis of Variance

| Source | Sum of Squares | Df | Mean Square | F-Ratio | P-Value |
|---|---|---|---|---|---|
| Model | 110999.0 | 8 | 13874.9 | 81.14 | 0.0000 |
| Residual | 9747.07 | 57 | 171.001 | | |
| Total (Corr.) | 120746.0 | 65 | | | |

R-squared = 91.9277 percent
R-squared (adjusted for d.f.) = 90.947 percent
Standard Error of Est. = 13.0767
Mean absolute error = 9.00527
Durbin-Watson statistic = 1.86196

Stepwise regression

Method: backward selection
F-to-enter: 4.0
F-to-remove: 4.0

Final model selected

The StatAdvisor

The output shows the results of fitting a multiple linear regression model to describe the relationship between totprod and 19 independent variables. The equation of the fitted model is:

Totprod = -704.273 + 1.7573*B1p10 + 1.30584*B1p1 + 2.60447*B1p24 + 0.765518*B1p6 + 3.82614*B2m46 + 0.109253*Brkg% + 1.08264*HGm14 + 0.039389*HGp3.

The R-Squared statistic indicates that the model as fitted explains 91.9277% of the variability in totprod. The adjusted R-squared statistic, which is more suitable for comparing models with different numbers of independent variables, is 90.7947%. The standard error of the estimate shows the standard deviation of the residuals to be 13.0767. This value can be used to construct prediction limits for new observations by selecting the Reports option from the test menu. The mean absolute error (MAE) of 9.00527 is the average value of the residuals. The Durbin-Watson (DW) statistic tests the residuals to determine if there is any significant correlation based on the order in which they occur in your data file. Since the DW value is greater than 1.4, there is probably not any serious autocorrelation in the residuals.

In determining whether the model can be simplified, notice that the highest P-value on the independent variables is 0.0243, belonging to Brkg%. Since the P-value is less than 0.05, that term is statistically significant at the 95% confidence level. Consequently, you probably don't want to remove any variables from the model.

FIG. 8

Multiple Regression Analysis

Dependent Variable: TotGrits

| Parameter | Estimate | Standard Error | T Statistic | P-Value |
|---|---|---|---|---|
| CONSTANT | -10.2399 | 9.54339 | -1.07299 | 0.2856 |
| B1m46 | -1.39083 | 0.370271 | -3.75625 | 0.0003 |
| B1p14 | 0.69054 | 0.0528822 | 11.5172 | 0.0000 |
| B1p6 | 0.219687 | 0.0349297 | 6.28941 | 0.0000 |
| B1p14 | 0.873478 | 0.0497441 | 17.5594 | 0.0000 |
| B2p30 | 1.0967 | 0.0301599 | 36.3628 | 0.0000 |
| Breakage | 0.124702 | 0.028885 | 4.31719 | 0.0000 |

Analysis of Variance

| Source | Sum of Squares | Df | Mean Square | F-Ratio | P-Value |
|---|---|---|---|---|---|
| Model | 431496.0 | 6 | 71915.9 | 623.78 | 0.0000 |
| Residual | 12912.6 | 112 | 115.291 | | |
| Total (Corr.) | 444408.0 | 118 | | | |

R-squared = 97.0944 percent
R-squared (adjusted for d.f.) = 9.9388 percent
Standard Error of Est. = 10.7374
Mean absolute error = 7.87294
Durbin-Watson statistic = 1.73647

Stepwise regression

Method: forward selection
F-to-enter: 4.0
F-to-remove: 4.0

Final model selected

The StatAdvisor

The output shows the results of fitting a multiple linear regression model to describe the relationship between TotGrits and 19 individual variables. The equation of the fitted model is:

Tot Grits = -10.2399 – 1.39083*B1m46 + 0.609054*B1p14 + 0.219687*B1p6 + 0.873478*B2p14 + 1.0967*B2p30 + 0.124702*Breakage Since the P-Value in the ANOVA table is less than 0.01, there is a statistically significant relationship between he variables at the 99% confidence level.

The R-Squared statistic indicates that the model as fitted explains 97.0944% of the variability in TotGrits.

FIG. 11

Multiple Regression Analysis

Dependent Variable: totprod

| Parameter | Estimate | Standard Error | T Statistic | P-Value |
|---|---|---|---|---|
| CONSTANT | -222.88 | 81.0015 | -2.75155 | 0.0079 |
| B1p14 | 0.806836 | 0.157321 | 5.1286 | 0.0000 |
| B1p24 | 2.84686 | 0.434515 | 6.55182 | 0.0000 |
| B1p6 | 0.300013 | 0.109544 | 2.73874 | 0.0082 |
| B2m46 | 4.63695 | 1.41296 | 3.28172 | 0.0018 |
| B2p14 | 1.4259 | 0.1733 | 8.22791 | 0.0000 |
| B2p30 | 1.00707 | 0.0924583 | 10.8921 | 0.0000 |
| HGM14 | 0.654402 | 0.246188 | 2.65813 | 0.0102 |
| RB1p16 | 1.95057 | 0.346329 | 5.63213 | 0.0000 |

Analysis of Variance

| Source | Sum of Squares | Df | Mean Square | F-Ratio | P-Value |
|---|---|---|---|---|---|
| Model | 113169.0 | 8 | 14146.2 | 106.42 | 0.0000 |
| Residual | 7577.04 | 57 | 132.93 | | |
| Total (Corr.) | 120746.0 | 65 | | | |

R-squared = 93.7248 percent
R-squared (adjusted for d.f.) = 92.8441 percent
Standard Error of Est. = 11.5295
Mean absolute error = 8.49708
Durbin-Watson statistic = 1.81482

Stepwise regression
Method: backward selection
F-to-enter:
F-to-remove:

Final model selected

The StatAdvisor

The output shows the results of fitting a multiple linear regression model to describe the relationship between totprod and 23 independent variables. The equation of the fitted model is:

Totprod = -222.88 + 0.806836*B1p1 + 2.84686*B1p24 + 0.300013*B1p6 + 4.63695B2m46 + 1.4259*B2p14 + 1.00707*B2p30 + 0.65440*HGm14 + 1.9505*RB1p16.

Since the P-value in the ANOVA table is less than 0.01, there is a statistically significant relationship between the variables at the 99% confidence level.

The R-Squared statistic indicates that the model as fitted explains 93.7248% f the variability in totprod. The adjusted R-squared statistic, which is more suitable for comparing models with different numbers of independent variables, is 92.8441%. The standard error of the estimate shows the standard deviation of the residuals to be 11.5295. This value can be used to construct prediction limits for new observations by selecting the Reports option from the text menu. The mean absolute error (MAE) of 8.49708 is the average value of the residuals. The Durbin-Watson (DW) statistic tests the residuals to determine if there is any significant correlation based on the order in which they occur in your data file. Since the DW value is greater than 1.4, there is probably not any serious autocorrelation in the residuals.

In determining whether the model can be simplified, notice that the highest P-value on the independent variables is 0.0102, belonging to HGm14. Since the P-value is less than 0.05, that term is statistically significant at the 95% confidence level. Consequently, you probably don't want to remove any variables from the model.

FIG. 13

Multiple Regression Analysis

Dependent variable: TotGrits

| Parameter | Estimate | Standard Error | T Statistic | P-Value |
|---|---|---|---|---|
| CONSTANT | -130.105 | 14.6169 | -8.90098 | 0.0000 |
| B1p14 | 0.647041 | 0.0208805 | 30.9878 | 0.0000 |
| B1p6 | 0.267306 | 0.0198443 | 13.4702 | 0.0000 |
| B2grit% | 292.509 | 28.3653 | 10.3122 | 0.0000 |
| B2p14 | 1.24334 | 0.0572574 | 21.7149 | 0.0000 |
| B2p30 | 0.707944 | 0.0450904 | 15.7005 | 0.0000 |
| HGm14 | -0.143527 | 0.0343534 | -4.17795 | 0.0000 |

Analysis of Variance

| Source | Sum of Squares | Df | Mean Square | F-Ratio | P-Value |
|---|---|---|---|---|---|
| Model | 1.00788E6 | 6 | 167979.0 | 1655.28 | 0.0000 |
| Residual | 42723.6 | 421 | 101.481 | | |
| Total (Corr.) | 1.0506E6 | 427 | | | |

R-squared = 95.9334 percent
R-squared (adjusted for d.f.) = 95.8755 percent
Standard Error of Est. = 10.0738
Mean absolute error = 7.4803
Durbin-Watson statistic = 1.41032

FIG. 15
(Page 1 of 3)

```
Stepwise regression
-------------------
Method: forward selection
F-to-enter: 4.0
F-to-remove: 4.0

     Step 0:
     ---------
     0 variables in the model.  427 d.f. for error.
     R-squared =   0.00%     Adjusted R-squared =   0.00%     MSE = 2460.42

     Step 1:
     ---------
     Adding variable B1p10 with F-to-enter = 1714.66
     1 variables in the model.  426 d.f. for error.
     R-squared =  80.10%     Adjusted R-squared =  80.05%     MSE = 490.783

     Step 2:
     ---------
     Adding variable B2p30 with F-to-enter = 168.884
     2 variables in the model.  425 d.f. for error.
     R-squared =  85.76%     Adjusted R-squared =  85.69%     MSE = 352.044

     Step 3:
     ---------
     Adding variable B1p14 with F-to-enter = 260.288
     3 variables in the model.  424 d.f. for error.
     R-squared =  91.18%     Adjusted R-squared =  91.11%     MSE = 218.649

     Step 4:
     ---------
     Adding variable B2p14 with F-to-enter = 186.053
     4 variables in the model.  423 d.f. for error.
     R-squared =  93.87%     Adjusted R-squared =  93.81%     MSE = 152.215

     Step 5:
     ---------
     Adding variable B1p6 with F-to-enter = 120.084
     5 variables in the model.  422 d.f. for error.
     R-squared =  95.23%     Adjusted R-squared =  95.17%     MSE = 118.777

     Step 6:
     ---------
     Adding variable B2grit% with F-to-enter = 54.3114
     6 variables in the model.  421 d.f. for error.
     R-squared =  95.77%     Adjusted R-squared =  95.71%     MSE = 105.455

     Step 7:
     ---------
     Removing variable B1p10 with F-to-remove = 0.934996
     5 variables in the model.  422 d.f. for error.
     R-squared =  95.76%     Adjusted R-squared =  95.71%     MSE = 105.438

     Step 8:
     ---------
     Adding variable HGm14 with F-to-enter = 17.4553
     6 variables in the model.  421 d.f. for error.
     R-squared =  95.93%     Adjusted R-squared =  95.88%     MSE = 101.481

     Final model selected.
```

FIG. 15
(Page 2 of 3)

The StatAdvisor
---

The output shows the results of fitting a multiple linear regression model to describe the relationship between TotGrits and 17 independent variables. The equation of the fitted model is TotGrits = -130.105 + 0.647041*B1p14 + 0.267306*B1p6 + 292.509*B2grit% + 1.24334*B2p14 + 0.707944*B2p30 - 0.143527*HGm14

Since the P-value in the ANOVA table is less than 0.01, there is a statistically significant relationship between the variables at the 99% confidence level.

The R-Squared statistic indicates that the model as fitted explains 95.9334% of the variability in TotGrits. The adjusted R-squared statistic, which is more suitable for comparing models with different numbers of independent variables, is 95.8755%. The standard error of the estimate shows the standard deviation of the residuals to be 10.0738. This value can be used to construct prediction limits for new observations by selecting the Reports option from the text menu. The mean absolute error (MAE) of 7.4803 is the average value of the residuals. The Durbin-Watson (DW) statistic tests the residuals to determine if there is any significant correlation based on the order in which they occur in your data file. Since the DW value is greater than 1.4, there is probably not any serious autocorrelation in the residuals.

In determining whether the model can be simplified, notice that the highest P-value on the independent variables is 0.0000, belonging to HGm14. Since the P-value is less than 0.01, the highest order term is statistically significant at the 99% confidence level. Consequently, you probably don't want to remove any variables from the model.

FIG. 15
(Page 3 of 3)

Multiple Regression Analysis

Dependent variable: TotMFG

| Parameter | Estimate | Standard Error | T Statistic | P-Value |
|---|---|---|---|---|
| CONSTANT | -4.57795 | 12.7313 | -0.359583 | 0.7193 |
| B1p14 | 1.0826 | 0.086221 | 12.5561 | 0.0000 |
| B1p46 | 3.24369 | 0.417519 | 7.76897 | 0.0000 |
| B1p6 | 0.636338 | 0.0528618 | 12.0378 | 0.0000 |
| B2m46 | 1.72924 | 0.843964 | 2.04895 | 0.0411 |
| B2p14 | 1.24226 | 0.0830139 | 14.9645 | 0.0000 |
| B2p30 | 1.04906 | 0.0923469 | 11.36 | 0.0000 |
| HGp14 | 0.0964877 | 0.0404747 | 2.3839 | 0.0176 |

Analysis of Variance

| Source | Sum of Squares | Df | Mean Square | F-Ratio | P-Value |
|---|---|---|---|---|---|
| Model | 2.73935E6 | 7 | 391336.0 | 594.08 | 0.0000 |
| Residual | 276666.0 | 420 | 658.728 | | |
| Total (Corr.) | 3.01602E6 | 427 | | | |

R-squared = 90.8268 percent
R-squared (adjusted for d.f.) = 90.6739 percent
Standard Error of Est. = 25.6657
Mean absolute error = 15.1308
Durbin-Watson statistic = 1.03928

Stepwise regression

Method: forward selection
F-to-enter: 4.0
F-to-remove: 4.0

Step 0:

0 variables in the model. 427 d.f. for error.
R-squared = 0.00% Adjusted R-squared = 0.00% MSE = 7063.27

Step 1:

Adding variable B1p10 with F-to-enter = 938.718
1 variables in the model. 426 d.f. for error.
R-squared = 68.78% Adjusted R-squared = 68.71% MSE = 2209.99

Step 2:

Adding variable B1p14 with F-to-enter = 440.299
2 variables in the model. 425 d.f. for error.
R-squared = 84.67% Adjusted R-squared = 84.60% MSE = 1088.01

Step 3:

Adding variable HGp6 with F-to-enter = 88.9103
3 variables in the model. 424 d.f. for error.
R-squared = 87.33% Adjusted R-squared = 87.24% MSE = 901.532

FIG. 17
(Page 1 of 3)

```
Step 4:
---------
Adding variable HGp14 with F-to-enter = 58.8463
4 variables in the model.  423 d.f. for error.
R-squared =  88.87%     Adjusted R-squared =  88.77%     MSE = 793.302

Step 5:
---------
Adding variable B2p10 with F-to-enter = 31.9489
5 variables in the model.  422 d.f. for error.
R-squared =  89.66%     Adjusted R-squared =  89.53%     MSE = 739.217

Step 6:
---------
Adding variable B1p46 with F-to-enter = 14.129
6 variables in the model.  421 d.f. for error.
R-squared =  89.99%     Adjusted R-squared =  89.85%     MSE = 716.913

Step 7:
---------
Adding variable B2grit% with F-to-enter = 15.6136
7 variables in the model.  420 d.f. for error.
R-squared =  90.35%     Adjusted R-squared =  90.19%     MSE = 692.863

Step 8:
---------
Adding variable B2p14 with F-to-enter = 5.63578
8 variables in the model.  419 d.f. for error.
R-squared =  90.48%     Adjusted R-squared =  90.30%     MSE = 685.299

Step 9:
---------
Adding variable B1p6 with F-to-enter = 12.4572
9 variables in the model.  418 d.f. for error.
R-squared =  90.76%     Adjusted R-squared =  90.56%     MSE = 667.058

Step 10:
---------
Removing variable B2grit% with F-to-remove = 1.89634
8 variables in the model.  419 d.f. for error.
R-squared =  90.71%     Adjusted R-squared =  90.54%     MSE = 668.485

Step 11:
---------
Adding variable B2p30 with F-to-enter = 6.24276
9 variables in the model.  418 d.f. for error.
R-squared =  90.85%     Adjusted R-squared =  90.65%     MSE = 660.224

Step 12:
---------
Removing variable B1p10 with F-to-remove = 1.17068
8 variables in the model.  419 d.f. for error.
R-squared =  90.82%     Adjusted R-squared =  90.65%     MSE = 660.493

Step 13:
---------
Removing variable HGp6 with F-to-remove = 2.09014
7 variables in the model.  420 d.f. for error.
R-squared =  90.78%     Adjusted R-squared =  90.62%     MSE = 662.208

Step 14:
---------
Removing variable B2p10 with F-to-remove = 1.96914
6 variables in the model.  421 d.f. for error.
R-squared =  90.74%     Adjusted R-squared =  90.60%     MSE = 663.732

Step 15:
---------
Adding variable B2m46 with F-to-enter = 4.19819
7 variables in the model.  420 d.f. for error.
R-squared =  90.83%     Adjusted R-squared =  90.67%     MSE = 658.728

Final model selected.
```

FIG. 17
(Page 2 of 3)

The StatAdvisor

---

The output shows the results of fitting a multiple linear regression model to describe the relationship between TotMFG and 17 independent variables. The equation of the fitted model is TotMFG = -4.57795 + 1.0826*B1p14 + 3.24369*B1p46 + 0.636338*B1p6 + 1.72924*B2m46 + 1.24226*B2p14 + 1.04906*B2p30 + 0.0964877*HGp14

Since the P-value in the ANOVA table is less than 0.01, there is a statistically significant relationship between the variables at the 99% confidence level.

The R-Squared statistic indicates that the model as fitted explains 90.8268% of the variability in TotMFG. The adjusted R-squared statistic, which is more suitable for comparing models with different numbers of independent variables, is 90.6739%. The standard error of the estimate shows the standard deviation of the residuals to be 25.6657. This value can be used to construct prediction limits for new observations by selecting the Reports option from the text menu. The mean absolute error (MAE) of 15.1308 is the average value of the residuals. The Durbin-Watson (DW) statistic tests the residuals to determine if there is any significant correlation based on the order in which they occur in your data file. Since the DW value is less than 1.4, there may be some indication of serial correlation. Plot the residuals versus row order to see if there is any pattern which can be seen.

In determining whether the model can be simplified, notice that the highest P-value on the independent variables is 0.0411, belonging to B2m46. Since the P-value is less than 0.05, that term is statistically significant at the 95% confidence level. Consequently, you probably don't want to remove any variables from the model.

FIG. 17
(Page 3 of 3)

GRANULAR MATERIAL TEST MILLING PROCESSES

BACKGROUND OF THE INVENTION

The corn kernel, illustrated in FIG. 1, has a number of components, each being best suited for various uses. The process of modern dry corn milling seeks to segregate and separately process the below-identified parts of a kernel of corn as each part has a separate commercial use. The hard outer shell is called the pericarp or the bran coat. The end of the corn kernel which adheres it to the corn cob is called the tip cap. The interior of the corn kernel consists of the endosperm and the germ. The endosperm is generally broken into two parts: soft endosperm and hard endosperm. For purposes of human consumption, the hard endosperm generally produces grits and corn meal, and the soft endosperm generally produces corn flour. The germ contains a much higher percentage of fat compared to the other parts of the kernel and is the source of corn oil.

Of course, dry corn milling is an ancient practice to the human race, dating back many, many years. Historically, mill stones were utilized to grind the corn into meal. Wind- and water-powered mills developed several hundred years ago allowed for increased efficiency in the processing of corn. For the last hundred years, milling operations have utilized roll milling equipment in an effort to separate the components of the corn kernel for more particularized uses.

Modern roll milling equipment utilizes contiguous rollers with varying sized corrugations and varying sized roller gap spacings to grind corn or other grains to achieve the desired particle size fractionation. Typically, mills employ rollers in series with increasingly narrow gaps in a gradual milling process. Through this process, the broken kernels are segregated by size which ideally results in various parts of the corn kernel being segregated and removed to differing processing pathways, often referred to as streams.

Initially, in a typical milling process, after cleaning the hard outer shell, the corn kernel is fractured via a mechanical process thereby freeing and removing the germ from the remaining parts of the kernel—a step called degermination. The remaining parts of the kernel are broken up by the series of rollers. As this material is processed, the hard outer shell (bran) flakes are removed and the remaining inner meat of the kernel—the soft and hard endosperm—are ground further as differing product streams pass through the series of rollers and sifters which separate product by particle size. The end products of the dry corn milling operation are bran, grits, meal, flour, and high fat germ.

A flow scheme typical of prior art mills is illustrated in U.S. Pat. No. 5,250,313. In FIG. 5, of the '313 patent (reproduced herein as FIG. 2), the incoming corn is cleaned, washed, tempered to the appropriate moisture content, fractured or degerminated, and dried. Various designs exist to carry out the step of degermination. For example, the Ocrim™ degerminator uses a spinning rotor having combination blades to operate against a horizontal, perforated cylinder that only allows partial kernels to pass. The rotor and breaker bars are set to break the corn against a spiral rotor bar and a cutting bar. Another known degerminator is the Beall™ degerminator. In the Beall™ degerminator, grinding occurs through an abrasive action of kernel against kernel, and kernel against a nested conical surface and screen. Impact-type degerminators are also used. An example is the Entoletor™ degerminator. The Entoletor™ includes a vertical drive shaft that operates a rotor. Kernels are fed downwardly towards the rotor where they are accelerated outwardly to impact a surrounding liner surface.

Generally, the product from the degerminator is separated into a first stream that is relatively rich in endosperm and a second stream that is relatively rich in germ and bran. Specifically, with reference again to FIG. 2, the degerminated corn is aspirated to effect initial density separation of the fractured kernel. The tailings and liftings from the aspirators are further separated through additional aspiration or the use of gravity tables. In general, bran, whole germ and germ contaminated particles obtained via density separation are lighter than other constituent parts and may be partially removed via gravity separation to be directed through a series of germ rollers and sifters (which may further separate germ from other components for separate processing in an oil recovery process). Separated, primarily endosperm-containing streams from the gravity tables and aspirators may be directed to different break rollers depending on the particle size of the stream. For example, those primarily endosperm-containing streams having smaller particle sizes may be directed past the first and second break rollers, or as illustrated in FIG. 2, beyond to later break rollers.

The "break rollers" used in a gradual break process typically comprise corrugated rollers having roller gaps that cascade from wider roller gaps for the 1st break roller to more narrow roller gaps for subsequent break rollers. Roller gaps are the spacings between the exterior or "tip" portions of the corrugations on opposing rollers. The use of 5 break rollers is typical, and roller gaps may vary depending on the desired finished product. Typical roller gap distances on prior art systems range from about 0.01 to about 0.07 inches, wherein smaller gaps result in finer particles. In general, the break rollers are operated such that opposing corrugated roller faces rotate at differing rates. Most roller corrugation configurations present a sharp edge and a dull edge as determined by the slope of the corrugation surface. Therefore, breaking may occur under a sharp to sharp, sharp to dull, dull to sharp, or dull to dull arrangement of opposing corrugations.

After break rolling, the further-broken particles are separated, typically by a sifting process. From there, larger particles are further rolled in a subsequent break roller (and the further-broken particles are again sifted), or they are passed on to drying or cooling steps or additional sifting steps to isolate finished products (flour, meal, grits, etc.). Typical finished-product requirements may be found generally in 21 CFR §§137.215-285 (1993). Of course other products may be desired by particular purchasers. The remaining particles that fail to pass the post germ sifting steps are typically sent to a germ handling process (labeled oil recovery in FIG. 2). The finer particles obtained from the germ roller siftings are processed in a manner generally similar to the finer particles from the break rollers.

In years past, all corn was received and milled with the dry miller accepting whatever percentage of the final product that could be derived from the corn. However, in an effort to maximize production of specific food products, today it is desirable to be able to select corn hybrids which have a higher proportion of the desired component. In traditional wet corn processing, the desired components are the soft endosperm and the germ. In traditional dry corn milling operations, the desired component is the hard endosperm.

With the advent of hybrid corns being developed in the 1930s, dry millers began to seek information in advance as to what percentage or yield of grits could be expected from a particular hybrid in the miller's production facilities. The sources of this information were "candling", speculation regarding grain millability characteristics based on agronomic data, and the collection of sample data from actual dry corn milling production runs.

Candling refers to the process of shining a light through a sample of kernels to obtain a very rough estimate of the relative percentage of germ, hard endosperm and soft endosperm in the kernels. Candling therefore is an imprecise method that may, literally, rely on the observation of shadows and which cannot provide detailed information to teach a miller how a given sample will perform in a given mill.

Analysis of grain based on agronomic data requires the observance of physical traits and a great deal of speculation regarding how the particular hybrid may perform in a given milling regime. Neither candling nor the analysis of agronomic data provide any information or data for the miller that relate directly to mill performance characteristics (millability of the corn). Millability characteristics relate not only to what the content of the sample kernels may be, but also to how the sample kernels will perform in a mill. Examples of such data include: the bran coat thickness, the relative ease or difficulty with which the germ may be removed from the endosperm, the relative ease or difficulty with which the bran coat may be removed from the endosperm, whether the bran coat or the endosperm are likely to be removed in large, intact portions or whether they are likely to fracture and contaminate finely ground streams, or how well the black tip cap will adhere to the germ.

All of the above described prior art methods were inefficient and produced highly variable results. In particular, the use of actual dry corn milling production runs demanded the utilization of production resources for substantial periods of time. Most troubling was the fact that the use of actual production facilities to test hybrids, and corn grown under different conditions or in different locations, demanded the processing and monitoring of large quantities of corn. For example, test runs by a known miller have utilized as many as 840,000 pounds of corn for a 24 hour run.

In general, the corn hybrid development process involves the isolation and development of inbred parent lines and the subsequent crossing of parent lines to create new hybrids. Because the development time for parent lines and hybrids are measured in generations or growing seasons, it could take many years to develop a hybrid to the point of commercial release (or to a point where market quantities are available for such tests). For example, given the quantities of corn recited above, it has been necessary to wait as long as seven or more growing seasons before a hybrid could be fully analyzed for milling suitability. Therefore, with traditional corn millability test methods such as production runs, a miller could truly test a hybrid's suitability for use in a particular milling process only after the hybrid became commercially available. This caused substantial investment by hybrid developers for an extended period of time before millers could even test a new hybrid. Therefore, there has been a need for information flow from the dry corn miller to the hybrid breeders to enable hybrid breeders to make breeding decisions and hybrid development decisions tailored to meet the millers' specific requirements and product specifications early in the breeding process.

A description of prior patents is provided below. Only approximately 5% of all corn grown is used for human consumption with the remaining 95% of the corn utilized in stock feeds, or in the production of sweeteners and alcohol. As a result, it appears that there has been limited patent activity regarding dry corn milling operations in general, and pilot or test milling operations in particular.

The Pollock patent, U.S. Pat. No. 1,117,963 issued Nov. 17, 1914, describes a method for test milling wheat and other grains. The '963 patent presents a full scale milling system which employs test chutes into which the product of the milling operation at particular points may be directed. The invention of the '963 patent relies upon an exact measurement of time to determine the results of the test. At the inception, the grain under test enters the processing system at a timed rate, and then the product of the milling operation can be removed at a corresponding timed rate with determination then made as to the amount of waste and exact proportions of the several products being produced. The '963 patent therefore relates to the previously described full scale production mill sampling or testing method.

In relation to the current invention, the '963 test system does not employ an independent test process which allows for a precise determination as to the products of the specific grain hybrid under examination. In addition, the '963 invention is not a bench scale test, but in fact is a full scale milling system. The only way in which the '963 system would allow for a determination of the percentage of products from a specific hybrid is to mill large quantities of the specific hybrid and measure the end result of this complete production run. This is highly time consuming and inefficient, and does not allow for the pre-selection of the desired grain or the analysis of pre-commercial hybrids that may only exist in small quantities.

The Anderson patent, U.S. Pat. No. 3,399,839, issued Sep. 3, 1968, describes a dry corn milling process which employs the addition of water for purposes of softening the bran to facilitate removal by an abrasive mechanical method, and to isolate and remove the germ from the kernel. The '839 patent discloses a milling production technique and does not present a process for the advanced determination of hybrid suitability for milling, or a "small" scale or "bench" scale testing protocol and method.

The Giguere patent, U.S. Pat. No. 5,250,313 issued Oct. 5, 1993, is similar to the '839 patent in that it describes yet another way to remove the bran and isolate and remove the germ from the corn being processed. It is a full scale production process, and it does not allow for a test or bench scale determination as to the expected end products from the dry milling of the specific hybrid of corn under analysis.

Therefore, there has been and remains a need for a testing method to provide accurate yield and grit production estimates in a short amount of time relative to full scale milling production runs. Also, there has been and remains a need for such a method to determine accurate yield and grit production estimates based on a small or bench scale simulation of the full scale milling process. In addition, there has been and remains a need for a method to identifY those data collection points within the simulation or bench-scale test that are determinative of the desired data, i.e. grit production, meal production, total product yield, etc. Finally, there is a need for a shortened simulation method based on these identified key data points to allow further streamlining of the micromill or test protocol by elimination of process steps from the simulation without sacrificing accuracy in the millability analysis. Such a shortened simulation would comprise an expedited lab technique capable of providing accurate millability predictions in a reduced amount of time relative to the longer small scale test simulation. Depending on the number of steps eliminated in the design of the shortened test protocol, up to ½ or more of the time required to perform the test may be eliminated.

It is therefore an object of the present invention to provide a shortened protocol and longer protocol small scale "miniature" or "micro-mill" simulations that impart the inherent advantages of allowing the test milling and analysis of a small or bench scale quantity of grain. With such small quantities, new corn hybrids may be tested many growing seasons prior to the commercial release of the hybrid. Importantly, this ability to test the milling suitability of pre-commercial hybrids early in the hybrid development process allows dry corn millers and hybrid developers to communicate and collaborate in the selection and development of hybrids for commercial release. Information derived through the pilot scale test milling process may therefore be used not only to help millers select the most beneficial hybrid for their desired process, but to more efficiently direct the hybrid breeding operation to produce grain having the specifically tailored requirements of the miller. This is in stark contrast to earlier attempts to gauge hybrid suitability for milling through the milling of full scale production-run quantities of grain, or through speculation regarding milling suitability based on physically observable traits and other agronomic data.

SUMMARY OF THE INVENTION

The present invention relates to a method for simulating a milling process to determine the suitability of grain samples for milling, a method for shortening the simulation protocol without sacrificing accuracy in the determination of suitability for milling, a method for employing the simulation and the shortened simulation to direct input grain selection for the full scale mill that is simulated, and a method for employing the simulation and the shortened simulation to direct hybrid development. The embodiments and advantages described herein are generally described with reference to corn and corn hybrids. However, it is clear that the benefits and advantages of the present invention relate more broadly to the testing and milling of other grains and other products wherein small scale test processing provides useful benefits by allowing early testing of newly developed strains, breeds, hybrids, designs or products, savings through the use of bench scale rather than full scale quantities, and decreasing production facility downtime through the separation of testing equipment from production equipment to avoid the use of production resources for testing purposes.

A small scale test milling process and method for determining anticipated hybrid performance is disclosed. The small scale test milling process allows accurate prediction of total mill yield (lbs. of input raw corn/lbs. of output finished product) and grit extraction percentage (lbs. of grit output/lbs. of raw corn input). The small scale test milling process is a simulation of a selected full scale or commercial milling facility. The small scale test milling process or simulation is referred to herein as the long-protocol test. This test generates accurate predictions for full scale mill performance based on the test milling of small samples (e.g. 1.0 kg of grain) and short time frames relative to full scale processes, which processes may employ tens to hundreds of thousands of pounds of grain depending upon the mill, sampling procedure, and run times.

In addition, the present invention includes a "shortened" small scale test milling process and a method for obtaining a "shortened" small scale test milling protocol based on the analysis of data generated in the long-protocol test milling process. It has been discovered that not only does the long-protocol small scale test milling process and simulation allow accurate prediction of total product yield and total grit extraction, but that key data from key data collection points within the long-protocol small scale test milling process may be identified and simulation process steps may be eliminated without sacrificing accuracy in the test results.

The long-protocol small scale test mill process includes the simulation of selected full scale production mill process steps—typically the sieving of raw corn, the conditioning of the sieved corn to an appropriate moisture content, the degermination of the conditioned corn, the aspiration of the degerminated or broken corn, the separation or sifting of the aspirated corn by size classes, and subsequent rolling, aspiration, and sifting steps. The sifting and rolling steps employ various roller gaps and mesh wire sizes, and the separated sample fractions from these sifting steps are weighed and recorded.

The shortened test mill process protocols were derived through the application of multiple linear regression analyses to model or fit equations (curves) to the measured data. These analyses revealed that, when testing is performed utilizing a lengthy series of simulation steps (e.g. repeated and gradual roller breaks and siftings) the end results, measured as total production yield and total grit extraction percentage, could be determined from a select few data points. It has therefore been discovered that key points in the simulation process of breaking, rolling and sifting the corn serve as extremely accurate predictors of total yield output and total grit production. As a result, the shortened small scale or test mill process need not employ all the rolling and sifting steps involved in the long-protocol or more complete small scale simulation of the production or full scale mill.

The current invention may utilize the traditional dry milling operation to break the kernels and allow for the removal of the bran. More significantly, it presents a process whereby the content of the hard endosperm, and the grits produced therefrom, can be determined in relation to a specific hybrid of corn. Importantly, because the present invention allows testing of small quantities of hybrid, it is not necessary to wait until commercial release of the hybrid to test its suitability. This may reduce the number of growing seasons that the mill or the hybrid developer must wait for a new hybrid to test, and provide significant information to the hybrid developer so that more focused trait selection may be made in developing the parent corn seed and in crossing that parent with another parent to produce the new hybrid possessing the desired characteristics. Therefore, the present invention also relates to methods for selecting grain and directing hybrid research through application of the simulation processes disclosed herein.

BRIEF DESCRIPTION OF THE DRAWINGS

FIG. 6 is demonstrative data illustrating the results of a regression analysis utilized to generate Equation 2.

FIG. 8 is demonstrative data illustrating the results of a regression analysis utilized to generate Equation 3.

FIG. 11 is demonstrative data illustrating the results of a regression analysis utilized to generate Equation 4.

FIG. 13 is demonstrative data illustrating the results of a regression analysis utilized to generate Equation 5.

FIG. 15 is demonstrative data illustrating the results of a regression analysis utilized to generate Equation 6.

FIG. 17 is demonstrative data illustrating the results of a regression analysis utilized to generate Equation 7.

DETAILED DESCRIPTION OF THE INVENTION

Figure 1:
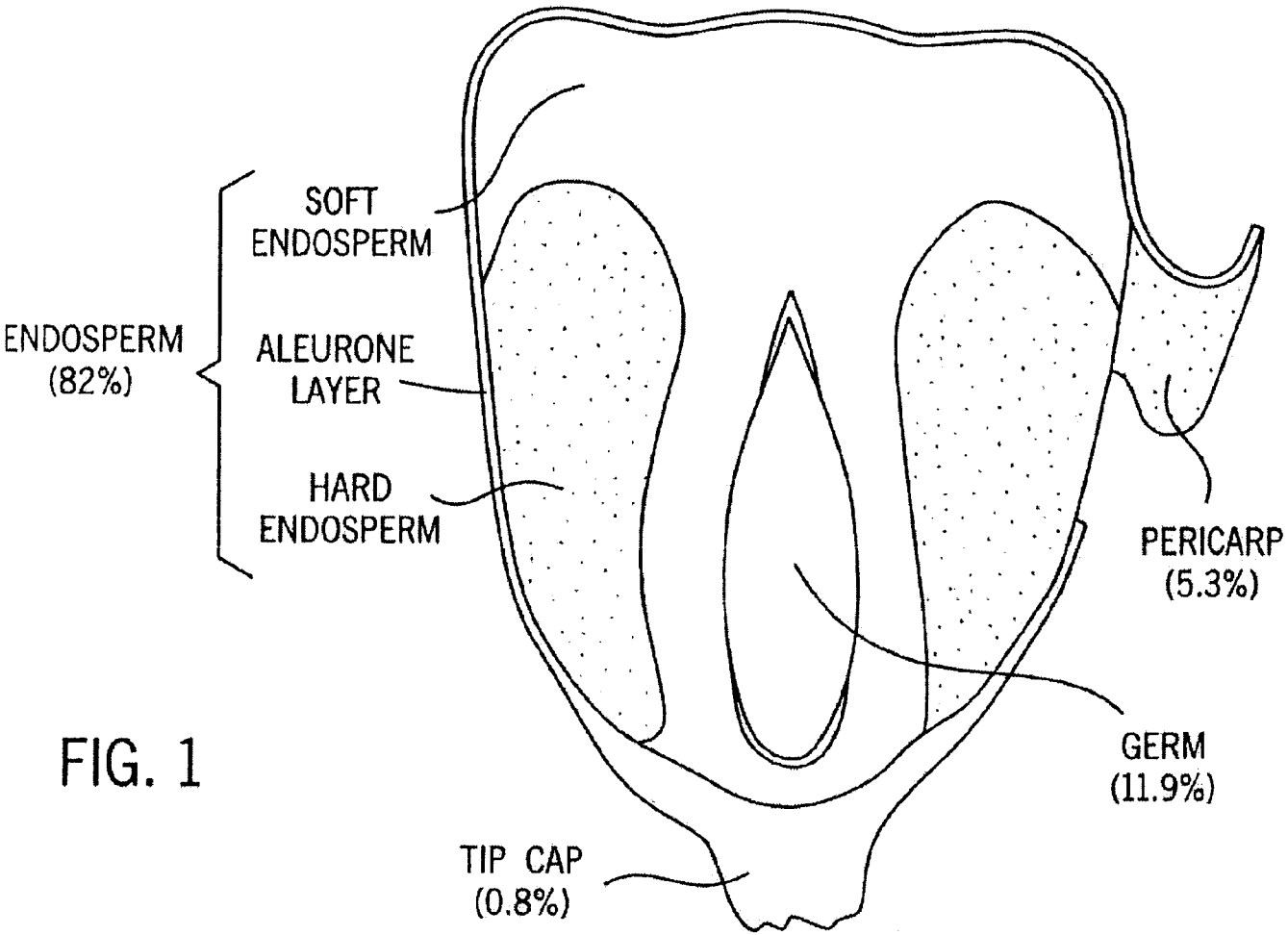
FIG. 1 is an enlarged representation of a kernel of corn illustrating the kernel's constituent parts.

As discussed, the present invention relates to a method for determining the suitability of a sample of grain for use in a milling process. In particular the method includes the small scale simulation of a full scale milling process including grinding (rolling) and separation steps which provides accurate predictive results of the amount and type of product which may be expected from a full scale production milling of the type of corn under analysis. Based on the small scale simulation, equations may be developed to eliminate steps from the small scale simulation to shorten the testing or simulation protocol to include only those steps necessary to generate data that will accurately describe milling suitability. The simulated milling processes of the present invention are described herein with reference to four embodiments. The first embodiment represents the "long-protocol" micro-mill or test milling process wherein a full scale mill is simulated in a bench scale process and data points from within the simulation process are used to determine total grit extraction percentages and total product yields. Based on a long-protocol test milling process, accurate shortened test mill simulation protocols or regimes may be developed. This is accomplished through an equation-fitting exercise wherein key data points from the long-protocol are identified as the data necessary to define the grit extraction percentage and total product yield. Based on these data points, long-protocol steps may be eliminated to design shortened test protocols if those steps to be eliminated do not generate data necessary to accurately define the grit extraction percentage and total product yield. The second, third and fourth embodiments disclosed herein relate to such shortened simulation protocols. Finally, with regard to each simulation or embodiment, a method is disclosed to apply the simulation for determination of the suitability of samples for milling and to select grain for milling or to direct corn hybrid development based upon the small scale simulation results.

First Embodiment: General Introduction to the Long-Protocol Bench Scale Test Milling Simulation The first embodiment is a small scale simulation of a full scale milling process wherein roller settings and screen sizes were selected to correlate to selected steps within a full scale milling process. As used herein the term "small scale" is synonymous with "lab", "pilot", "test", or "bench" scale. These terms refer to smaller-than-full-scale milling processes wherein the quantity of grain required to obtain meaningful results is a convenient quantity to handle, or a "pre-commercial" quantity of hybrid (i.e. a small enough quantity to enable the analysis of hybrid varieties generations prior to the availability of production scale quantities of the hybrid, and generations earlier in the hybrid breeding process). These terms also refer to sample sizes of grain that are substantially smaller than the grain quantities typically purchased by commercial millers, or substantially smaller than the grain quantities contained in normal shipments or loads, such as train car loads, truck loads, barge loads, etc. In other words, heretofore a miller would have to test a full scale production run as large as 840,000 pounds of corn to learn how productive that corn hybrid and specific crop would be in the dry milling process. With this invention, the same information may now be obtained with a "small" sample of corn. The bench scale equipment utilized in the simulations may be commensurate in size with the small scale samples. For the long-protocol simulation described herein as the first embodiment, and for the second, third and fourth embodiments (which are shortened tests based on the long-protocol test), the tests are small or bench scale test milling processes. Preferably, the small scale sample is a 1 kg sample of raw corn. Use of a 1 kg sample allows for ease of calculations. Other test or small scale sample sizes may be used, partially processed or pretreated corn may be used, and other grains may also be used. The process is valuable for use with all grains wherein the testing of smaller production scale quantities is a desirable function for economical testing or for new strain or hybrid development. As previously stated, this functionality is especially beneficial for analysis and direction of corn hybrid development.

Figure 2:
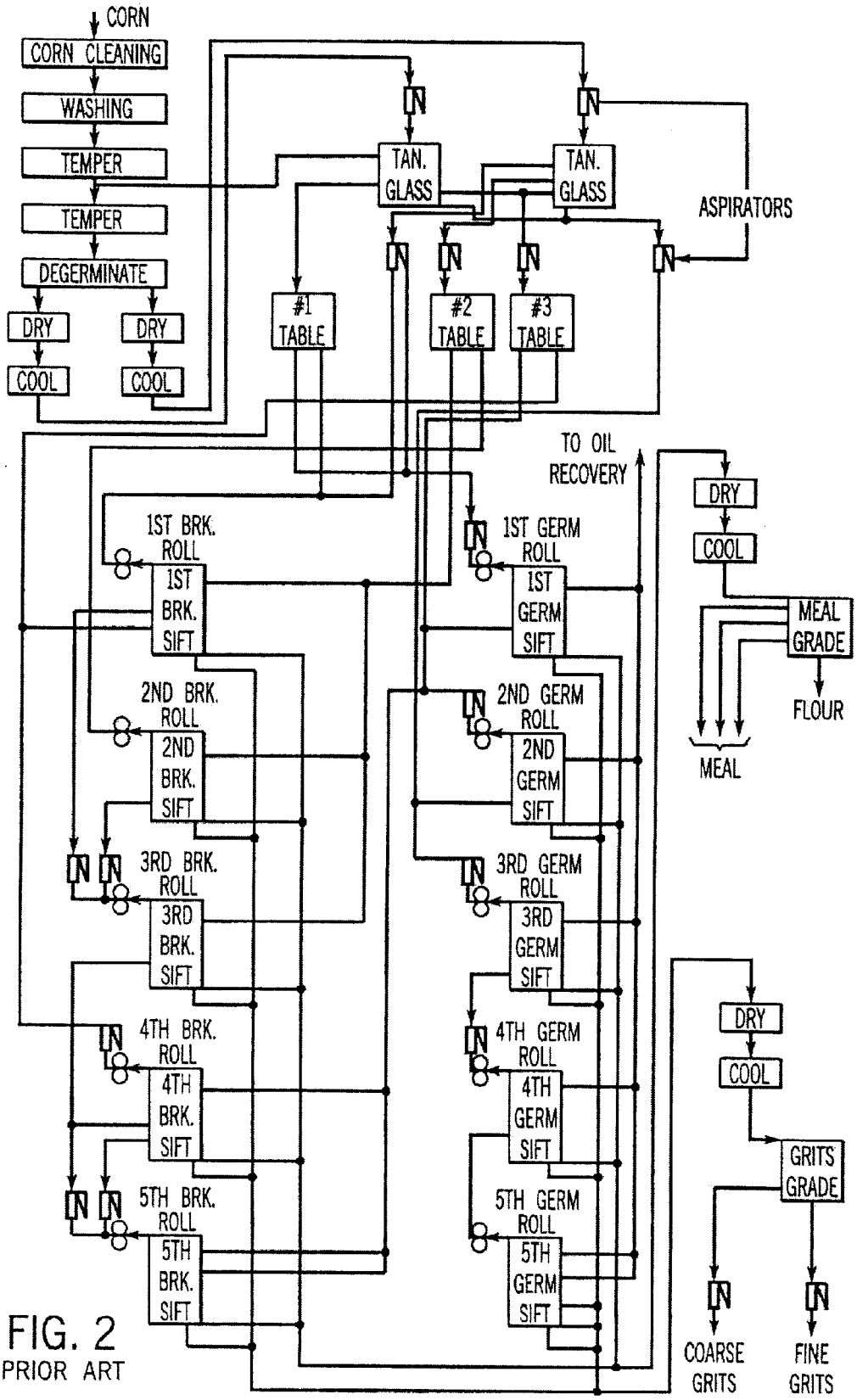
FIG. 2 PRIOR ART
FIG. 2 is an example of a prior art full scale production mill flow regime.
Figure 3:
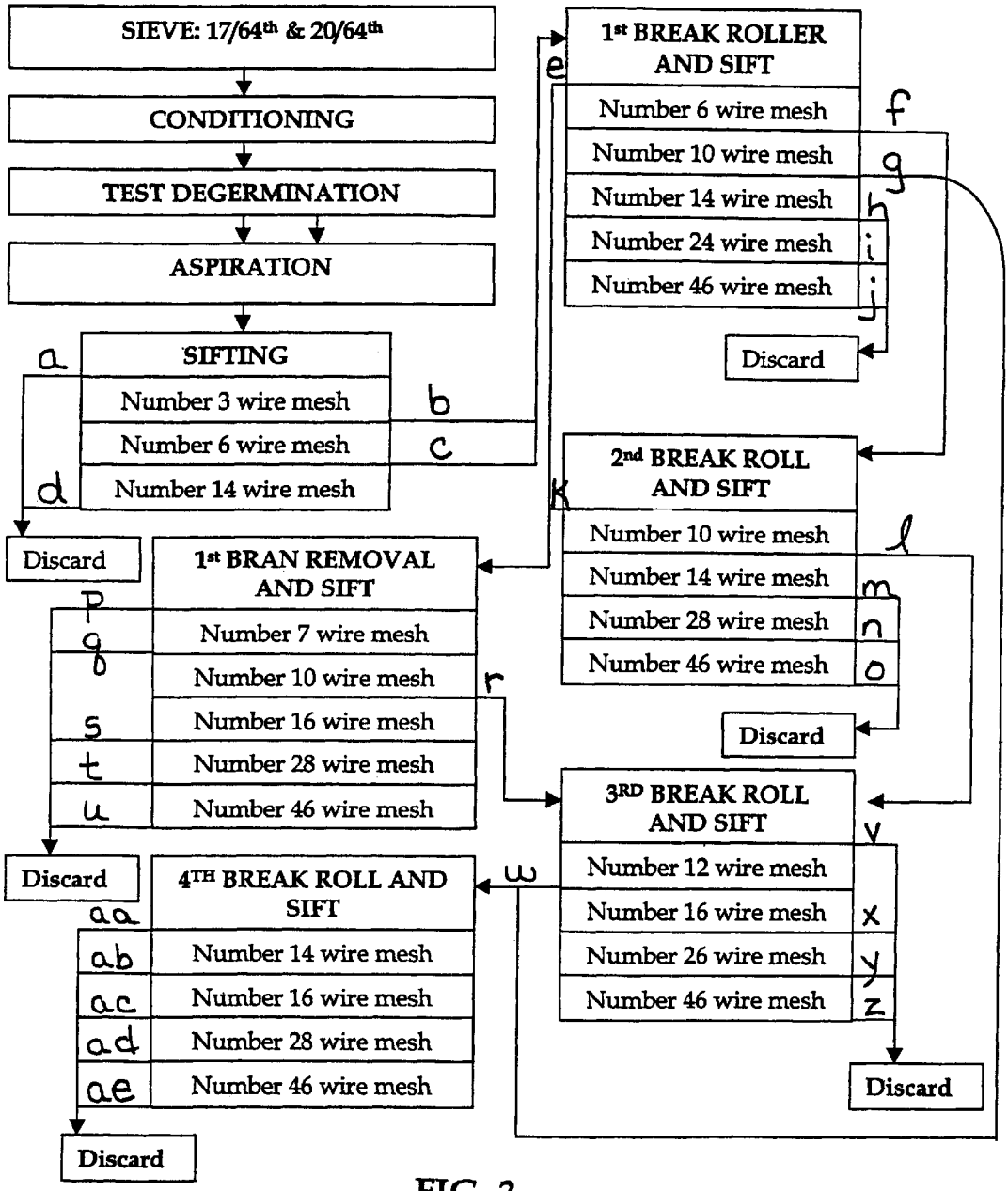
FIG. 3 is a flow chart that demonstrates a first test mill protocol for a first embodiment of the invention.

The "long-protocol" bench scale test utilizes a sample of raw kernels of grain and bench scale equipment. The bench scale equipment is configured to simulate selected steps from a full scale milling facility. To select the steps from the full scale milling facility to be simulated it is first necessary to identify and understand the flow regime of the full scale facility. This full scale flow regime is therefore analyzed to determine which process steps serve as the sources for the end product which is the subject of the analysis. In general, full scale gradual milling processes (as illustrated in FIG. 2) use redundant systems and the recycling of product streams that roll and re-roll product numerous times to maximize the extraction of the desired components for finished products such as grits, meal, and flour. In the selection of process steps to include in the small scale simulation, only those process steps that support the production of the desired end products need to be included. For example, if grit extraction percentage is the characteristic to be measured, then the full scale milling process streams that produce directly (or, indirectly, lead to the production of) grits are selected. Therefore, if a full scale process diverts a stream comprising mainly oil-bearing germ to a separate facility for oil recovery, then the diverted germ stream and the process steps involved in oil recovery would not necessarily be modeled in the bench scale simulation. By contrast, if a stream within the full scale milling flow regime was directed towards finished product handling as grits (directly or indirectly), the process steps applicable to that stream would be selected for simulation.

Through study of a full scale process, the destination and future process steps to which any given sample or stream of product will be directed in the flow regime may be determined. Therefore, it is possible to determine which process streams support the production of the desired end product, and which process streams comprise "by-products" or products other than the specific end product(s) under analysis. By identifying those streams which support the production of the desired end products, process steps and grain flow patterns from the full scale production facility may be eliminated from the long-protocol test mill simulation.

It will also be appreciated that the input streams to any given process may comprise "mixed" streams from different sources (streams comprised partially of product from earlier process steps in the flow regime and partially of product being returned from later process steps for re-treatment or further processing). In the mixed stream, each source may comprise a different percentage of the overall stream or flow and therefore bear greater or lesser importance in the determination of desired end product to be produced from that stream. For example, if a rolling and sifting step receives 98% of its flow from an earlier sifting step and 2% of its flow as return from a later sifting step, then the 98% flow component will bear greater weight in the determination of output produced from the stream. Therefore, in the selection of process steps to be included in the long protocol test milling simulation, it will be appreciated that some return streams may be eliminated from the simulation protocol without sacrificing accuracy in the ability of the simulation to predict full scale mill performance.

Although it may be possible to eliminate many streams or processes from the full scale mill facility in the design of the simulation protocol, some of the eliminated streams may need to be accounted for in the simulation through factors or coefficients to approximate the amount of the stream that, ultimately, will lead to the production of a desired end product. For example, with reference to FIG. 2, where a coarse stream may be diverted from the Break Rollers directly to the Germ Rollers, a large portion of that stream is likely to leave the milling processes and be directed towards oil recovery. However, in the germ rolling process, some endosperm is likely to be further separated from the germ and at least a portion of this separated endosperm is ultimately directed towards meal or flour production. Therefore, to simplify the simulation and expedite testing, it may be preferable to eliminate the germ rolling steps from a simulation and simply account for the production of flour, meal, or other finished product from the eliminated process step by recording the amount of the sample that would have been sent to the eliminated process and applying a coefficient to this weight to account for the fraction of that product stream that would have been recovered from that sample or stream in the full scale milling facility. Typically, such "recovery" streams are of lesser importance in the production of the desired finished product relative to other streams, and the approximation introduced herein is therefore possible without sacrificing accuracy in the simulation predictions.

Steps selected in the first embodiment include cleaning, conditioning, degermination, aspiration, and four break roller steps, preferably with aspiration preceding and sifting following each step, in addition to a post degermination sifting and a separate rolling and sifting step to eliminate renegade bran (bran roller, bran reduction, or "1RB"). The sifting or separation steps utilize cascading series of wire mesh screens having gradually smaller screen openings to permit the separation of the product sample into fractions by size class. Of course, other separation means may be employed to effect the desired separation by size class and it is not important that wire mesh screens or sieving be utilized. Following screening or separation, the separated fractions are weighed and these weights are recorded. Depending on the flow regime of the full scale production mill being simulated, selected fractions may be discarded, and other selected fractions are sent to subsequent rolling (grinding) and sifting steps.

First Embodiment: The Long-Protocol Bench Scale Test Milling Simulation

Under the long test protocol, a 1.0 kg sample of cleaned kernels is selected and hand sieved over a $^{17}/_{64}{}^{th}$ inch and $^{20}/_{64}{}^{th}$ inch hand sieve. The sample size may be any convenient small-scale sample size as previously described, but a 1.0 kg sample is preferred for ease of calculations on a percentage basis and on bases expressed as quantities of grits or other products relative to the input sample size. The weight of the sample fraction contained in each fraction of the $^{17}/_{64}{}^{th}$ inch and $^{20}/_{64}{}^{th}$ inch sieve separations are recorded. The material that fails to pass the $^{20}/_{64}{}^{th}$ screen is referred to as +20. The material that fails to pass the $^{17}/_{64}{}^{th}$ sieve is referred to as +17. The material that passes the number 17 screen is referred to herein as "breakage". Preferably, the −17 or "breakage" fraction is obtained by subtracting the other two fractions from the initial total sample weight. This initial sieving step allows determination of the "breakage" and provides data, as is known to those of skill in the art, reflective of the size homogeneity of the sample and the degree or extent of kernel breakage within the initial sample. Here, as throughout, other mesh screen sizes may be employed depending on the millers' preferred practices and desired end products. Next, the separate size classes of the 1.0 kg sample are mixed or combined and the 1.0 kg sample is conditioned as with drying, or steam or water moisturizing to a desired moisture content in the approximate range of 10–20%, preferably 16% (although the desired moisture content may vary depending upon the full scale process under simulation).

The conditioned sample is then subjected to degermination and the product of degermination is sifted in a post degermination sifter (referred to herein as the "hominy grader"). The product is preferably fed in a controlled manner into the degerminator, as with a vibratory feeder or other feeding mechanism. In the degerminator, the germ is separated from the kernel by mechanical force and the remaining kernel is broken into several pieces. After degermination, the sample is aspirated and liftings from the aspirator are weighed, recorded, and removed from the testing stream. Aspiration steps are preferably included prior to all of the different rolling steps described herein. By aspirating prior to rolling, additional bran may be removed before it becomes further ground in the rollers into particle sizes too small to be easily separated from the remaining product sample or stream. The preferred aspirators are typically columns of cascading, angled planes through which sample is passed. At intermittent points in the cascade, ports exist to allow the entry of an air stream to blow bran or other fractions away from the endosperm and into a separate "liftings" stream. The aspirators, like the break rollers and the separators, are adjusted to settings that produce a liftings sample of substantially similar composition to the liftings stream in the full scale production mill (composition referring to distribution of bran, grits, meal, germ, etc.). Similarly the speed of rotation on the preferred degerminator is set to simulate the impact force generated in the full scale production mill degerminator. As these comments illustrate, initial design of the long-protocol simulation test is best performed through trial and error using a known hybrid for which liftings, degermination effectiveness and roller performance are known. Once such settings are determined for a known hybrid, those test variables may be fixed to allow comparative analysis of different hybrids. In addition, at least a portion of the data obtained from small scale simulations is preferably compared to data from full scale tests (prior art tests) to verify the accuracy of the selected simulation protocol for a given full scale mill.

In the hominy grading step, the sample is separated by size gradations, preferably through sifting in a Great Western Laboratory sifter, and the separated sample fractions are weighed. The preferred wire mesh screens employed for hominy grading are number 3, 6, and 14 wire mesh screens, although the particular screen selection may vary depending upon the full scale production facility to be simulated. The weights recorded as data from the hominy grading are referred to below in Table 1 as fractions a, b, c, and d. Fractions a, b, and c represent the grams of sample that remain above the screens (fail to pass through the number 3, 6, and 14 screens, respectively). Fraction d represents the grams of sample that pass through the number 14 screen. The fraction that fails to pass the number 3 mesh screen and the fraction that passes the number 14 mesh screen (data points a and d), having been separated, weighed, and recorded, are thereafter discarded. The remaining product fractions (fractions b and c) are directed towards a $1^{st}$ break roller.

The fractions that are discarded following the hominy grading comprise the coarsest ground (fraction a) and the most finely ground (fraction d) particles obtained from the degerminator. The discarding of these fractions simulates the diversion of corresponding fractions or streams in the full scale milling facility. Typically, the coarser fraction from the hominy grading step would, in a full scale production run, be diverted to secondary processing to further separate germ and bran from endosperm. The germ portion would then be processed to recover oil, the bran might be used to make bran flour, and the endosperm may be ground into flour or returned to the production stream at a later point. Typically these steps would involve further separations via gravity tables, aspirators, or other separation means. Where the "diverted" streams from the full scale production mill (represented by discarded streams in the small scale simulation test mill) are further processed and used to generate finished product, total product yield and total grit extraction calculations may need to account for these discarded streams as discussed above. Importantly, the weight of the sample has been recorded prior to discarding the sample and this weight, or a function of this weight may be used to aid in the determination of finished products such as meal, flour, grits, etc.

The 1st break roller is preferably a 6 inch test mill having a 6 inch diameter roller that is 8" long, a ½ inch spiral, 14 corrugations per inch, and a roller gap setting of approximately 0.057 inches. Of course, depending on the full scale production mill being simulated, and the desired finished product output, the selection of bench scale equipment, including but not limited to rollers, sifters, and degerminators, may vary. In production runs and production scale settings, the initial roller gap setting is typically altered after start-up to attain the desired fractionation of particle sizes. However, for test milling operations, it is preferred to fix the roller gap setting to eliminate test variables. Therefore, although full scale production mill roller gap settings may be determined after start-up to place the appropriate fraction of the product particle stream in different sifting size categories, this post-start-up adjustment process is preferably eliminated from the bench or small scale test protocol. Instead, the test mill roller gap settings are set at an initial width to achieve the desired fractionation obtained from the full scale production mill.

The sample that was retained following hominy grading and directed towards the $1^{st}$ Break Roller (fractions b and c) should be fed through the $1^{st}$ Break Roller slowly to prevent uncontrolled breakage. This rolled sample is then sifted for approximately two minutes using the lab sifter over number 6, 10, 14, 24, and 46 wire mesh screens. Again, as before, the selection of screens is determined with reference to the full scale production facility under simulation. Screen sizes may vary widely as each miller may utilize slightly different gradations to identify different finished products. Although federal regulations define acceptable particle size ranges for finished product flour, meal, and grits, there is room for millers' discretion within these defined ranges and distributions. Further, even the screen sizes and particle sizes designated in the federal regulations are not necessarily limiting as custom milling projects may require differently graded particle size streams.

The separated and weighed fractions of the product sample from the $1^{st}$ Break Roller are labeled fractions e, f, g, h, i, and j. Fractions e, f, g, h, and i represent those fractions of sample from the $1^{st}$ Break Roller (preferably measured in grams) that failed to pass through the number 6, 10, 14, 24, and 46 wire mesh screens, respectively. Data point j represents that fraction of the sample from the $1^{st}$ Break Roller that passed through the number 46 wire mesh. Having been rolled, sifted, weighed and recorded, fraction e is sent to the 1RB ($1^{st}$ Removal of Bran Sub-System) roller, fraction f is sent to the $2^{nd}$ Break Roller, fraction g is sent to the $4^{th}$ Break Roller, and the remaining fractions (h, i, and j) are discarded.

Preferably, the same roller is utilized for each break rolling step and the 1RB ($1^{st}$ Removal of Bran Sub-System) rolling step, but, if lab space permits or if preferred, separate break rollers may be employed. Of course the use of separate rollers results in time savings due to the elimination of a need to reset roller gaps between rolls, but this efficiency is achieved at the expense of additional test mill equipment investment and additional space requirements.

For the $2^{nd}$ Break Roll, the roller gap is preferably set to 0.030 inches and the product is rolled for approximately 2 minutes. The product directed to the $2^{nd}$ Break Roller (fraction f) is fed into the roller at a generally slow and consistent rate to eliminate uncontrolled breakage. After the $2^{nd}$ break, the product is sifted over number 10, 14, 28, and 46 wire mesh screens. Various-sized screens may be used depending on the full scale production mill and desired finished product characteristics. For example, number 24, 26, 28, 30, or other screens might be chosen to replace the number 28 screen depending on the desired fat content of the grits (particle size fractionation decisions may impact germ content or germ contamination of streams and higher germ content in a sample typically means higher fat content in the finished product of that sample). The separated fractions from the $2^{nd}$ break roll screens are weighed and these data are recorded and referred to as fractions k, l, m, n, and o in Table 3 below. From the $2^{nd}$ break separations, fraction k is directed towards the $1^{st}$ Bran Reduction roller and fraction l is directed towards the $3^{rd}$ Break Roller. The remaining fractions (fractions m, n, and o) are discarded. Again, as with other test process steps described herein, the discarded fractions reflect, generally, choices made to simulate the diversion of product in the full scale production mill from the milling stream to finished product streams, germ handling streams, redegermination streams, or other processes as used in the full scale production mill.

The 1RB (1st Removal of Bran Sub-System) Roller utilizes a roller gap setting of 0.035 inches. This gap setting is relatively wide for a rolling step at this point in a gradual milling process. Such a gap was chosen to simulate the bran removal action of the full scale 1RB Roller, which is not intended to effect substantial additional grinding, but which increases bran separation from other kernel components through mechanical abrasion in a more gentle, or relatively wide, roller gap. The 1RB sifting employs number 7, 10, 16, 28, and 46 wire mesh screens. These separations are weighed and recorded as fractions p, q, r, s, t, and u. Fraction r is directed to the 3rd Break Roller and the remaining sample is discarded. In the full scale production mill flow regime, at least one of the fractions from the 1RB Roller sifting step is returned to the 2nd Break Roller for re-grinding. However, in the full scale production mill, each fraction represents a stream of kernels or ground particles as contrasted with the test mill simulation wherein each sample fraction represents a discrete and identifiable quantity of kernels and kernel portions. Therefore, although the full scale milling process may "recycle" portions of the grain through the same steps more than once (in a continuous flow process), the preferred test simulation eliminates these return streams in order to simplify the simulation flow regime. As previously discussed, if the recycled stream comprised a substantial portion of the input to the 2nd Break Roller, then elimination of the recycle flow from the simulation would be a possible source of error. Of course, the benefit of eliminating such a flow pattern from the simulation is the dramatic simplification of the simulation flow regime. If such streams were included, the simulation would no longer comprise a simple test, but rather it would entail iterative steps due to the "feedback loop" of a return stream. Therefore, although the present invention relates generally to the use of a small scale simulation of a full scale milling process, it is preferred to eliminate return flows from the simulation whenever possible.

The 3rd Break Roller receives fractions l and r, as stated above, and utilizes an aggressive roller gap setting of 0.010 inches. The post 3rd Break Roller sifting employs numbers 12, 16, 26, and 46 wire mesh screens. These separations are weighed and recorded as fractions v, w, x, y, and z. Fraction x (that fraction of the sample that failed to pass through the number 16 wire mesh screen), is directed to the 4th Break Roller and the remaining sample is discarded or set aside.

The 4th Break Roller utilizes a roller gap setting of 0.021 inches. The post 4th Break Roller sifting employs numbers 14, 16, 28, and 46 wire mesh screens. These separations are weighed and recorded as fractions aa, ab, ac, ad, and ae. After weighing and recording these values, these final fractions may be discarded Representative data collected from selected runs under the test protocol of the first embodiment are presented below in Tables 1–9.

In Table 1, the first column indicates a test number associated with the accompanying data and the accompanying corn hybrid. Column 2 identifies the corn hybrid. Columns 3, 4 and 5 indicate the grams of product obtained from the initial sieve of raw product. Column 3 "Breakage" indicates the amount of raw corn that passed through the 17/64" sieve. Column 4 entitled "+20" indicates that amount of the product which failed to pass the 20/64" sieve. Finally, the fifth column entitled "−20/+17" represents the grams of product that passed the 20/64" sieve but failed to pass the 17/64" sieve. For a given sample of hybrid, the data contained in Table 1 illustrates the general degree of size-homogenization of the sample. Typically, the Breakage is important data because the −17 fraction is known to represent mostly broken kernels from which the germ is likely to have been released. When germ from the input corn has already been released, it is likely that this germ may be lost to feed or product streams other than the germ stream. This is undesirable not only because germ contamination of other streams results in higher fat content, but because feed is a lower-value milling by-product than the germ stream which is a high-value by-product important for oil recovery.

TABLE 1

| | | SIEVE | | |
|---|---|---|---|---|
| Test | Hybrid | Breakage (−17) | +20 | −20/+17 |
| 1 | 1 | 9.6 | 879.1 | 111.3 |
| 2 | 1 | 2.9 | 934.9 | 62.2 |
| 3 | 1 | 2.7 | 903.8 | 93.5 |
| 1 | 2 | 4.9 | 866.6 | 128.5 |
| 2 | 2 | 2.6 | 915.9 | 81.5 |
| 1 | 3 | 501.4 | 451.6 | 47 |
| 1 | 4 | 6.5 | 898.8 | 94.7 |
| 1 | 5 | 5 | 920.8 | 74.2 |
| 2 | 5 | 6.1 | 933.9 | 60 |
| 1 | 6 | 4.1 | 908.3 | 87.6 |
| 2 | 6 | 19.2 | 893.2 | 87.6 |
| 3 | 6 | 5.2 | 905.1 | 89.7 |
| 1 | 7 | 3.4 | 803.7 | 192.9 |

Table 2 illustrates the grams of product obtained from the different mesh screens of the hominy grader. Again, columns 1 and 2 represent the test and hybrid identifiers ven samples. Columns 3, 4, 5, and 6 represent fractions a, b, c, and d. It is noted that the grams of product represented by fractions a, b, c, and d for Test 1, Hybrid 1 sum to less than the input sample as illustrated in Table 1. This discrepancy is explained, in part, by the aspiration steps which precede the hominy grader sifting. The aspiration step results in the loss of bran and possibly other components. In addition, moisture loss may occur throughout testing especially as kernels are broken into smaller particles and the amount of surface area, from which moisture may evaporate, increases. Although not illustrated in the Tables 1–7 or referenced at each sifting step herein, it is a preferred practice to record the weights of all "liftings" (materials removed via aspiration) obtained through aspiration steps.

TABLE 2

| | | HOMINY GRADER | | | |
|---|---|---|---|---|---|
| Test | Hybrid | +3 (a) | +6 (b) | +14 (c) | −14 (d) |
| 1 | 1 | 5.4 | 478.7 | 353.4 | 99.8 |
| 2 | 1 | 33.5 | 589.5 | 237.5 | 79 |
| 3 | 1 | 23.9 | 576.3 | 259 | 92.6 |
| 1 | 2 | 26.5 | 579.9 | 252.4 | 87.5 |
| 2 | 2 | 30.2 | 597.6 | 235.6 | 76.6 |
| 1 | 3 | 9 | 294.2 | 124.8 | 43.8 |
| 1 | 4 | 34.2 | 569.4 | 266.2 | 68.5 |
| 1 | 5 | 24.2 | 562.6 | 266.9 | 91.6 |
| 2 | 5 | 29.2 | 557.4 | 274.8 | 87.7 |
| 1 | 6 | 38.3 | 623.6 | 219.4 | 69.3 |
| 2 | 6 | 23.7 | 629 | 235.1 | 71 |

TABLE 2-continued

| HOMINY GRADER | | | | | |
|---|---|---|---|---|---|
| Test | Hybrid | +3 (a) | +6 (b) | +14 (c) | −14 (d) |
| 3 | 6 | 5.4 | 622.7 | 276.6 | 60.8 |
| 1 | 7 | 21.7 | 653.5 | 209.4 | 71.3 |

In Tables 3, 4, 5, 6 and 7, data is compiled in a manner similar to that shown in Table 2. In Tables 4 through 7, a grit percentage is provided as an additional final column. The grit percentage illustrated in Table 4 represents the weight of fraction m (a sample of medium particle size granulation appropriately sized for classification as grits that is discarded after being weighed and recorded) divided by the total weight of fractions k, l, m, n, and o. For example, in the first row of data in Table 4, for Test 1 of Hybrid 1, fraction m weighed 169.4 grams. This comprised 46.6% of the product that passed through the second break sifter step. This grit percentage is recorded in the table as 47% (rounded to nearest whole percentage point). This grit "percentage" is therefore a "composite" variable, and it may represent valuable data for a miller to use for an analysis of process efficiencies within a given flow regime.

TABLE 3

| 1st BREAK | | | | | | | |
|---|---|---|---|---|---|---|---|
| Test | Hybrid | +6 (e) | +10 (f) | +14 (g) | +24 (h) | +46 (i) | −46 (j) |
| 1 | 1 | 74.4 | 371.8 | 236.5 | 93 | 31.3 | 19.1 |
| 2 | 1 | 94.9 | 365.8 | 204.8 | 94.3 | 37.6 | 25.4 |
| 3 | 1 | 93.3 | 377.8 | 206 | 91.2 | 36.5 | 23.6 |
| 1 | 2 | 99 | 413.6 | 179.2 | 76.8 | 33.9 | 23.2 |
| 2 | 2 | 115.9 | 408.7 | 168.5 | 74.6 | 33.6 | 23.1 |
| 1 | 3 | 31.8 | 211.9 | 97.3 | 40.8 | 18.3 | 13.3 |
| 1 | 4 | 96.6 | 403.8 | 192.3 | 77.5 | 33.3 | 24 |
| 1 | 5 | 85.1 | 350.5 | 226.7 | 101.1 | 37.1 | 22.8 |
| 2 | 5 | 110.8 | 352.2 | 213.6 | 91.5 | 34.1 | 21.6 |
| 1 | 6 | 58.6 | 377.5 | 228.3 | 108.1 | 40.8 | 24.2 |
| 2 | 6 | 59.8 | 395.5 | 229.7 | 107.2 | 41.2 | 24.1 |
| 3 | 6 | 90.6 | 410.2 | 231.4 | 102.7 | 37.3 | 21.4 |
| 1 | 7 | 83.8 | 399.9 | 208.4 | 99.9 | 39.3 | 23.9 |

TABLE 4

| 2nd BREAK | | | | | | | |
|---|---|---|---|---|---|---|---|
| Test | Hybrid | +10 (k) | +14 (l) | +28 (m) | +46 (n) | −46 (o) | Grit % |
| 1 | 1 | 71.9 | 93.9 | 169.4 | 16.9 | 11.2 | 47% |
| 2 | 1 | 67 | 88.5 | 175 | 18 | 11.7 | 49% |
| 3 | 1 | 70.6 | 91.2 | 178.1 | 18.4 | 12.2 | 48% |
| 1 | 2 | 71.9 | 103.5 | 194.5 | 21.2 | 14.7 | 48% |
| 2 | 2 | 75.4 | 104 | 188.8 | 20.9 | 14.5 | 47% |
| 1 | 3 | 33.1 | 55.2 | 99.5 | 11.5 | 8.4 | 48% |
| 1 | 4 | 57.5 | 94.4 | 202.6 | 23.1 | 17.5 | 51% |
| 1 | 5 | 61.8 | 72.8 | 178.2 | 19.5 | 13 | 52% |
| 2 | 5 | 66.1 | 74.6 | 174.8 | 19 | 12.9 | 50% |
| 1 | 6 | 68.5 | 98.8 | 176.8 | 17.5 | 11.8 | 47% |
| 2 | 6 | 74.6 | 103.1 | 182.1 | 18.1 | 12 | 47% |
| 3 | 6 | 92.4 | 117.9 | 166.8 | 15.7 | 10.3 | 41% |
| 1 | 7 | 72.6 | 100 | 187.2 | 19.7 | 13 | 48% |

Similarly, in Table 5, the grit percentage was measured as the fraction s weight divided by the total weight of fractions p, q, r, s, t, u, and v. In Table 6, the grit percentage is measured as the fraction x weight divided by the total weight of fractions v, w, x, y, and z. Finally, in Table 7, the grit percentage is measured as the weight of fractions ab and ac divided by the total weight of fractions aa, ab, ac, ad, and ae.

The selection of fractions to represent grit extraction percentages further illustrates the manner in which the test mill is a simulation of a full scale production milling facility. Each fraction identified herein for use in the grit percentage calculations (fractions m, s, x, ab, ac) represents a separate stream in the full scale production mill flow regime. These streams in the full scale production mill, directly or indirectly through further processing, produce finished product meal without any further substantial diversion of product to other end uses (flour, etc.). Therefore, these diverted streams are identified in the full scale milling facility, and they are represented by samples in the simulation that are isolated and removed from further steps in the test protocol regime.

TABLE 5

| 1RB | | | | | | | | |
|---|---|---|---|---|---|---|---|---|
| Test | Hybrid | +7 (p) | +10 (q) | +16 (r) | +28 (s) | +46 (t) | −46 (u) | Grit % |
| 1 | 1 | 29.1 | 62.0 | 33.9 | 14.0 | 2.2 | 2.2 | 10% |
| 2 | 1 | 40.7 | 60.5 | 37.1 | 15.7 | 2.9 | 2.2 | 10% |
| 3 | 1 | 42.2 | 63.8 | 36.0 | 15.0 | 2.7 | 2.4 | 9% |
| 1 | 2 | 38.3 | 66.7 | 41.3 | 16.5 | 3.2 | 2.7 | 10% |
| 2 | 2 | 50.1 | 72.1 | 44.5 | 16.8 | 3.5 | 2.8 | 9% |
| 1 | 3 | 11.1 | 25.7 | 17.0 | 7.8 | 1.4 | 1.3 | 12% |
| 1 | 4 | 27.8 | 55.6 | 43.6 | 18.7 | 3.7 | 3.1 | 12% |
| 1 | 5 | 40.7 | 59.9 | 28.9 | 12.0 | 2.6 | 2.0 | 8% |
| 2 | 5 | 63.0 | 65.5 | 29.6 | 12.1 | 2.4 | 2.1 | 7% |
| 1 | 6 | 19.7 | 57.6 | 31.7 | 11.6 | 2.0 | 1.8 | 9% |
| 2 | 6 | 22.3 | 62.5 | 34.1 | 11.3 | 2.2 | 1.7 | 8% |
| 3 | 6 | 47.4 | 82.4 | 39.0 | 12.1 | 2.1 | 2.1 | 7% |
| 1 | 7 | 33.8 | 65.5 | 37.3 | 14.2 | 2.7 | 2.4 | 9% |

TABLE 6

| 3rd BREAK | | | | | | | |
|---|---|---|---|---|---|---|---|
| Test | Hybrid | +12 (v) | +16 (w) | +26 (x) | +46 (y) | −46 (z) | Grit % |
| 1 | 1 | 5.6 | 6.4 | 59.6 | 39.9 | 12.8 | 48% |
| 2 | 1 | 4.8 | 5.1 | 59.8 | 41.7 | 13.3 | 48% |
| 3 | 1 | 5.8 | 6.5 | 56.5 | 39.8 | 13.7 | 46% |
| 1 | 2 | 6.7 | 7.2 | 66.1 | 43.1 | 14.7 | 48% |
| 2 | 2 | 5.5 | 7.1 | 69.7 | 46.6 | 15.6 | 48% |
| 1 | 3 | 2.3 | 2.6 | 34 | 23.2 | 8.6 | 48% |
| 1 | 4 | 4.8 | 4.8 | 61.4 | 46.2 | 16.8 | 46% |
| 1 | 5 | 7.1 | 7.3 | 51.7 | 24.2 | 8.2 | 52% |
| 2 | 5 | 7.6 | 8.3 | 51.4 | 25.3 | 8 | 51% |
| 1 | 6 | 5.3 | 5.7 | 61 | 41.7 | 13.9 | 48% |
| 2 | 6 | 6.1 | 7.3 | 63.1 | 43 | 14.4 | 47% |
| 3 | 6 | 10.7 | 13 | 79.8 | 35.3 | 10.6 | 53% |
| 1 | 7 | 6.6 | 7.6 | 72.2 | 34.9 | 11.3 | 54% |

TABLE 7

| 4th BREAK | | | | | | | |
|---|---|---|---|---|---|---|---|
| Test | Hybrid | +14 (aa) | +16 (ab) | +28 (ac) | +46 (ad) | −46 (ae) | Grit % |
| 1 | 1 | 46.4 | 41.1 | 123.2 | 16.4 | 9.3 | 70% |
| 2 | 1 | 39.1 | 33.5 | 109.8 | 14.9 | 8.7 | 70% |
| 3 | 1 | 41.2 | 34.8 | 108.6 | 15.1 | 8.3 | 69% |
| 1 | 2 | 42.9 | 31.9 | 87.8 | 12.4 | 7.7 | 66% |
| 2 | 2 | 41.9 | 31.9 | 81.4 | 11.7 | 6.7 | 65% |
| 1 | 3 | 25 | 15.8 | 46.8 | 5.2 | 3.8 | 65% |
| 1 | 4 | 45.1 | 35.1 | 90.9 | 12.9 | 8.5 | 65% |

TABLE 7-continued

| | | 4th BREAK | | | | | |
|---|---|---|---|---|---|---|---|
| Test | Hybrid | +14 (aa) | +16 (ab) | +28 (ac) | +46 (ad) | −46 (ae) | Grit % |
| 1 | 5 | 0 | 37.6 | 118.6 | 16.7 | 9.7 | 86% |
| 2 | 5 | 45.2 | 39.1 | 108.3 | 15.4 | 8.7 | 68% |
| 1 | 6 | 51.2 | 38.5 | 116.2 | 15.1 | 8.6 | 67% |
| 2 | 6 | 52.3 | 41 | 113.4 | 15.1 | 8.3 | 67% |
| 3 | 6 | 65.5 | 50.6 | 104.7 | 12.7 | 7.1 | 65% |
| 1 | 7 | 53.2 | 40.3 | 96.1 | 13 | 7.4 | 65% |

In Table 8, the first and second columns again represent test identifiers and hybrid identifiers. The third column, "Test Grits" represents the total grams previously referred to as a measurement for grits (fractions m, s, x, ab, and ac). This value is also presented as a percentage of the total sample weight from the beginning of the test protocol.

The fifth column, "Total Meal/Flour" is obtained through application of equation 1 below:

$$\text{Total Meal/Flour}=(d)+(h)+(i)+(j)+(n)+(o)+(0.67*q)+(t)+(u)+(0.67*v)+(y)+(z)+(0.67*aa)+(ae) \quad \text{Equation 1}$$

In the full scale production facility being simulated by the long protocol of the first embodiment, fractions q, v, aa and ae all represent fractions diverted from the grit production pathway towards processes for isolation of flour or meal. Therefore, each stream in the full scale production mill that relates to these fractions is further processed to produce meal and flour or to remove bran or germ for oil recovery. Based on analysis of the full scale production facility it was determined that approximately 67% of the weight of these diverted streams becomes flour or meal. In the test mill protocol to simulate ultimate meal and flour production, a factor or coefficient of 67% is therefore used. The remaining variables used in Equation 1 represent product streams that comprise meal or flour streams.

The "Liftings" as reported in Table 8 represent those grams of product removed through the aspiration steps. Finally, the "Total Yield" tabulated in Table 8 for the long protocol represents the grams of grit as shown in column 3 plus the total grams of meal and flour as shown in column 5 minus the grams of liftings as shown in column 6. As recorded, the total yield is provided as a multiplier to represent how many weight units of raw corn are required to produce one weight unit of finished product.

TABLE 8

| Test | Hybrid | Test Grits | Total Grit % | Total Meal/Flr | Total Liftings | Total Yield |
|---|---|---|---|---|---|---|
| 1 | 1 | 407 | 41% | 397.5 | 68.1 | 1.36 |
| 2 | 1 | 394 | 41% | 393.6 | 59.8 | 1.37 |
| 3 | 1 | 393 | 40% | 400.2 | 53.7 | 1.35 |
| 1 | 2 | 397 | 41% | 390.1 | 59.6 | 1.37 |
| 2 | 2 | 389 | 40% | 385.0 | 62.5 | 1.41 |
| 1 | 3 | 204 | 21% | 200.7 | 31.2 | 5.68 |
| 1 | 4 | 409 | 42% | 383.2 | 60.4 | 1.37 |
| 1 | 5 | 398 | 41% | 363.2 | 59.1 | 1.42 |
| 2 | 5 | 386 | 40% | 379.0 | 53.1 | 1.41 |
| 1 | 6 | 404 | 42% | 408.4 | 53.5 | 1.32 |
| 2 | 6 | 411 | 42% | 415.9 | 49.1 | 1.29 |
| 3 | 6 | 414 | 42% | 404.3 | 42.3 | 1.29 |
| 1 | 7 | 410 | 42% | 399.2 | 46.7 | 1.31 |

Therefore, as illustrated in the foregoing tables, grit extractions were tabulated based on select screenings following the second, third and fourth break rollers in addition to the bran reduction roller step. The total grit extraction percentages listed in tables 4, 5, 6, and 7 represent the percent of the volumetric flow across the respective roller break that comprised grit (for the second break, the plus 28 stock(fraction m); for the bran reduction roller, the plus 28 stock(fraction s); for the third break, the plus 26 stock (fraction x); for the fourth break, the plus 16 stock (fraction ab), and the plus 28 stock fraction ac)). The total grit extraction expressed in Table 8 represents the sum of the fractions identified as grit extractions divided by the total weight of the original sample. The total meal/flour represents the total weight of those fractions identified as the source for finished product meal or flour. Finally, Total Yield represents the weight of the original sample divided by the total weight of meal, grits and flour. Total Yield is therefore expressed as grams of input raw corn required to produce one gram of finished product. Of course, Total Yield could be expressed as an extraction percentage, but as is known in the art, it is common to express the Total Yield in the manner presented in Table 8.

In light of the foregoing, it will be apparent to one of ordinary skill in the art that the present invention relates to a method for testing the milling suitability of grain by simulating a full scale milling facility in a small or bench scale test. A protocol is developed to simulate the rolling (grinding) and sifting steps that occur in the full scale production facility and to simulate the diversion of product streams from the mill flow regime. From simulation or small scale test data, product yield including meal, flour, and grits may be calculated as functions of the input sample size.

Preferably, the data collected under the protocols of the present invention are utilized to determine the suitability of a sample of grain to meet selected production goals. For example, in the first embodiment, the invention may further comprise a method for applying the collected data to determine a millability rating that is a function of grit extraction and total product yield. Each hybrid tested is assigned a millability rating based upon a combination of the total grit extraction % and the total yield. Although different millers may preferentially assign different weights to the grit extraction % and the total yield, a preferred embodiment is explained herein.

First Embodiment: Data Application to Composite Milling Suitability Ratings

The present invention may also include the further steps of applying the collected data to determine a composite milling suitability rating or "millability rating." This process includes the additional steps of normalizing the derived data, assigning a weight to each separate item of normalized data, and combining the normalized data to achieve a composite characteristic for the grain under analysis. For example, the preferred millability factor is determined by giving the total grit production a rating of 0 to 7 depending on the level of grit production from the test. The rating is based on the grit extraction relative to expected or typical extraction values. Then the yield is similarly given a rating of 0 to 7. The grit percentage is weighted 60% and the yield is weighted 40% to attain the "millability factor." Tables 10 and 11 illustrate grit extraction percentage ranges and yield ranges that may be associated with assigned ratings to be used to normalize test data for determination of the millability factor.

It will be understood that the millability factor is subject to miller's requirements and that the process of assigning a millability factor may be altered in both the methods for deriving ratings, and the methods for combining ratings to develop factors. What is important to the analysis, of course, is the process of normalizing the grit extraction percentage and the yield rating on the same scale, assigning weights to each normalized value, and combining the normalized values to determine a composite rating.

TABLE 9

| Test | Hybrid | Grit Rating 0–7 | Yield Rating 0–7 | Millability Rating 0–7 |
|---|---|---|---|---|
| 1 | 1 | 0.00 | 4.00 | 2 |
| 2 | 1 | 0.00 | 3.00 | 1 |
| 3 | 1 | 0.00 | 4.00 | 2 |
| 1 | 2 | 0.00 | 3.00 | 1 |
| 2 | 2 | 0.00 | 1.00 | 0 |
| 1 | 3 | 0.00 | 0.00 | 0 |
| 1 | 4 | 0.00 | 3.00 | 1 |
| 1 | 5 | 0.00 | 0.00 | 0 |
| 2 | 5 | 0.00 | 1.00 | 0 |
| 1 | 6 | 0.00 | 6.00 | 2 |
| 2 | 6 | 0.00 | 7.00 | 3 |
| 3 | 6 | 0.00 | 7.00 | 3 |
| 1 | 7 | 0.00 | 6.00 | 2 |

TABLE 10

| Grit extraction ranges (per 1.0 kg) | | |
|---|---|---|
| Min % | Max % | Rating |
| 0 | 43.5 | 0 |
| 43.5 | 45.0 | 1 |
| 45.0 | 46.5 | 2 |
| 46.5 | 48.0 | 3 |
| 48.0 | 49.5 | 4 |
| 49.5 | 51.0 | 5 |
| 51.0 | 52.5 | 6 |
| 52.5 | Above | 7 |

TABLE 11

| Yield Ranges | | |
|---|---|---|
| Min | Max | Rating |
| Above | 1.42 | 0 |
| 1.42 | 1.40 | 1 |
| 1.40 | 1.38 | 2 |
| 1.38 | 1.36 | 3 |
| 1.36 | 1.34 | 4 |
| 1.34 | 1.32 | 5 |
| 1.32 | 1.30 | 6 |
| 1.30 | Below | 7 |

Second, Third, and Fourth Embodiments (Shortened Test Protocols): Introduction The method of the present invention for utilizing a small scale simulation of a full scale production facility to determine total product yield and grit extraction has been described herein with reference to a long protocol test. However, the present invention also relates to shortened small scale simulation protocols for acquiring the necessary grit extraction or total product yield data. Whereas the long protocol is more complete in its simulation of the full scale production mill facility, the shortened protocols simulate only those steps shown to be useful for providing significant data for accurately identifying product yield and total grit extraction %.

It has been discovered that selected data obtained from the long protocol may be used to accurately determine grit extraction % and total product yield. These selected data and the method for applying such data to determine grit extraction % and product yield are obtained through an equation-fitting analysis of the data collected from the long-protocol. Therefore, the second, third, and fourth embodiments presented herein comprise shortened protocols for the collection of more limited data and the application of this data through derived equations to accurately determine total product yields and grit extraction percentages. The benefits of designing and utilizing such shortened protocol tests include dramatic time savings which allow the testing of many more hybrids in a given amount of time and with a given amount of labor in the laboratory. Simply put, the elimination of. process steps from the testing protocol directly impacts the time required to perform the tests, analyze the data, and determine corn hybrid suitability for milling.

Multiple linear regression models were applied to describe the relationship between the collected data and the total grit extraction percentage and to describe the relationship between the collected data and the total product yield. As is known in the art of statistical analysis, multiple linear regression analyses are used to fit a response (dependent) variable as a linear combination of multiple independent variables. As explained below (and not with reference to the fraction labels as used previously herein), the linear function that is the correct model in a multiple linear regression analysis is:

$$Y=a0+a1*X1+a2*X2+\ldots+an*Xn+e[i]$$

In the multiple linear regression model, Y is the dependent variable, X1 . . . Xn are the independent variables, a0 is the intercept (if all X values are zero), and e[i] is the error term. The X values are fixed in the model (as the input test data being analyzed), the e[i] values are independent and normally distributed with a mean of 0 and identical variances, and the dependent variable Y is normally distributed with the same variance that exists for the e[i] variables (although Y need not be normal for estimation tests, only for hypothesis testing). Computer models that are known in the statistical arts may be used to apply multiple linear regression analyses to obtain linear models to explain the relationships within given sets of data.

In the present invention, numerous multiple linear regression analyses were performed upon the data obtained from the long protocol test simulations. FIGS. 6, 8, 11, 13, 15, and 17 provide examples of the output from six of such regression analyses performed with the aid of a computer. When such analyses were performed, two different methods were used—stepwise regression with forward selection and stepwise selection with reverse selection. With forward selection, independent variables were added to each regression that was performed to "build" the fitted equation, or curve, comprising a linear combination of significant independent variables. With reverse or backwards regression, initial regressions utilized all independent variables (a–ae) or limited groups of independent variables (limited groups selected to exclude independent variables representing data points the modelers hoped to eliminate) and insignificant independent variables were eliminated as regression steps were performed.

The "P-values" obtained from a regression analysis for each independent variable (see FIGS. 6, 8, 11, 13, 15, and 17) describe the probability that a test statistic (predicted value) will be at least as extreme as the value that is actually observed. If this probability is lower than a pre-selected significance level, then the variable may be treated as non-significant. Similarly, "F-statistics" may be used to eliminate non-significant variables. In the data provided, independent variables were not included in the model if the F-statistic that was returned in association with the addition or removal of that variable satisfied the selected test. In this manner, the suite of independent variables used to accurately determine the value of the dependent variables, Total Grit Extraction Percentage and Total Product, was narrowed through elimination of insignificant independent variables, or built through the addition of significant independent variables.

Page 2 of FIG. 15 provides an example of a stepwise forward selection regression analysis that utilized F-to-enter and F-to-remove tests with values of 4.0. Just as statistical significance may be selected to be 95% (significance indicated by "P-values" less than 0.05), but can vary depending on the level of significance desired, a statistician, data analyst, engineer, or miller may select an F-to-enter/remove value to be at a desired level. 4.0 is a commonly used F-to-enter/remove value and was selected for use with the present invention. Step 0 of FIG. 15 indicates that the initial regression step, Step 0, utilized no independent variables and returned an R-squared value of zero based on the inclusion of 427 degrees of freedom (data points). In each of Steps 1 through 6, a variable was added when the F-to-enter test was satisfied (significance of that variable as represented by the statistical factor F shown to be greater than 4). Again in Step 8, a variable was added when the F-to-enter test was satisfied. In Step 7, a reverse or backwards selection step was employed. Therefore, in Step 7 the F-to-remove test was applied and satisfied where the statistical Factor associated with the removal of the variable was less than the benchmark or test level of 4.0. Therefore, in Step 7 an independent variable was removed from the model because it was determined that the variable was not significant to determination of the dependent variable. As illustrated by a comparison of Steps 6 and 7, the elimination of the variable in Step 7 did not alter the adjusted R-squared value and slightly lowered the mean standard error.

In FIGS. 6, 8, 11, 13, 15, and 17, numerous statistical "factors" are provided including the P-values, R-squared values, adjusted R-squared values, F-statistics, and standard error terms. The selection of a "best fit" model or equation is dependent upon which statistical factor the modeler wishes to emphasize. For example, in FIG. 6 which relates to Equation 2 presented below, the adjusted R-squared factor is 93.4812% and the standard error is 1.05589. In FIG. 8 which relates to Equation 3 presented below, the adjusted R-squared factor is 90.7947% and the standard error is 13.0767. In FIG. 11 which relates to Equation 4 presented below, the adjusted R-squared factor is 96.9388% and the standard error is 10.7374. In FIG. 13 which relates to Equation 5 presented below, the adjusted R-squared factor is 92.8441% and the standard error is 11.5295. In FIG. 15 which relates to Equation 6 below, the adjusted R-squared factor is 95.8755% and the standard error is 10.0738. In FIG. 17 which relates to Equation 7 below, the adjusted R-squared factor is 90.6739% and the standard error is 25.6657.

The selection of a resultant model is dependent upon which model characteristics the dry corn miller believes to be most important for prediction accuracy. For example, in FIG. 6 the adjusted R-squared value is 93.4812%. This statistic means that 93.4812% percent of the variation seen in the Total Grit Extraction % variables are explained by model, i.e. the correlation between observed and model-predicted data under Equation 2 is 93.4812% (wherein 100% represents perfect correlation between model and observed data). Alternatively, a miller may elect to emphasize minimization of standard error rather than correlation as evidenced by adjusted R-squared. As illustrated in FIG. 6, the standard error associated with Equation 2 was 1.05589. Therefore if a miller or modeler desires to emphasize correlation rather than the minimization of standard error, Equation 4 would be preferred over Equation 2 and Equation 5 would be preferred over Equation 3. Of course, because Equation 5 includes data for fraction r (the weight of the fraction that passes through the number 10 wire mesh screen following the $1^{st}$ Bran Removal roller), the use of Equation 5 will demand more simulation steps and a longer test protocol (the $1^{st}$ Bran Removal roller was not employed in the simulation illustrated in FIG. 4 which uses equations 2 and 3). Therefore, for models or equations of generally comparable accuracy, as measured by comparison of selected statistical factors, it may be desired to select that model which minimizes data collection.

$$\text{Grit Extraction }\%=6.12117-0.298715*i+0.13029*f+0.144905*h-0.0960314*j-0.108827*k-0.0735187*l-0.435525*n+0.0117753*(\text{Breakage})+0.0104458*c \qquad \text{Equation 2}$$

$$\text{Yield}=-704.372+1.7573*f+1.30584*g+2.60447*h+0.765518*e+3.82614*o+0.109253*(\text{Breakage})+1.08264*d+0.939389*a \qquad \text{Equation 3}$$

$$\text{Grit extraction }\%=-10.2399-1.39083*j+0.609054*g+0.219687*e+0.873478*l+1.0967*m+0.124702*(\text{Breakage}) \qquad \text{Equation 4}$$

$$\text{Total Product Yield}=-222.88+0.806836*g+2.84686*h+0.300013*e+4.63695*o+1.4259*l+1.00707*m+0.654402*d+1.95057*r \qquad \text{Equation 5}$$

$$\text{Total Grit }\%=-130.105+0.647041*g+0.267306*e+292.509*(2^{nd}\text{ Break Roller Grit Extraction }\%)+1.24334*l+0.707944*m-0.143527*d \qquad \text{Equation 6}$$

$$\text{Total Product}=-4.57795+1.0826*g+3.24369*i+0.636338*e+1.72924*o+1.24226*l+1.04906*m+0.0964877*c \qquad \text{Equation 7}$$

It is, of course, possible that different linear models obtained through regression analyses may allow accurate prediction of Total Grit Extraction % and Total Product. Further, such equations or models may be obtained through the application of alternative curve fitting analyses, including other linear models or even non-linear models that are generally known to those of ordinary skill in the statistical arts.

FIGS. 5, 7, 10, 12, 14, and 16 illustrate plots of observed data points (grit extraction percentages and total product weights observed through application of the long-protocol test simulation of the first embodiment) vs. predicted data points obtained through the application of Equations 2–7, respectively. These figures correspond to the regression summaries of FIGS. 6, 8, 11, 13, 15, and 17 respectively.

Having presented an explanation of the regression analyses whereby data is analyzed to obtain limited data sets and equations that apply these limited data sets to define Total Grit Extraction % and Total Product as functions of those limited data sets, the long protocol test may be shortened to eliminate those steps not required to obtain the limited data sets. These shortened protocols are presented below.

Therefore, an embodiment of the present invention relates to an improved method for testing a sample of grain to determine milling suitability wherein: first, a full scale production facility is modeled in a small scale simulation, second data collected from the small scale simulation is used to generate accurate predictions of how the grain sample will perform in the full scale mill, and third, statistical analysis is applied to identify key data points, eliminate steps from the simulation, and produce a streamlined bench scale testing protocol wherein a minimum number of steps are applied to obtain those data points necessary to accurately predict the performance of a grain in the full scale production mill.

Second, Third and Fourth Embodiments, Detailed Description

Figure 4:
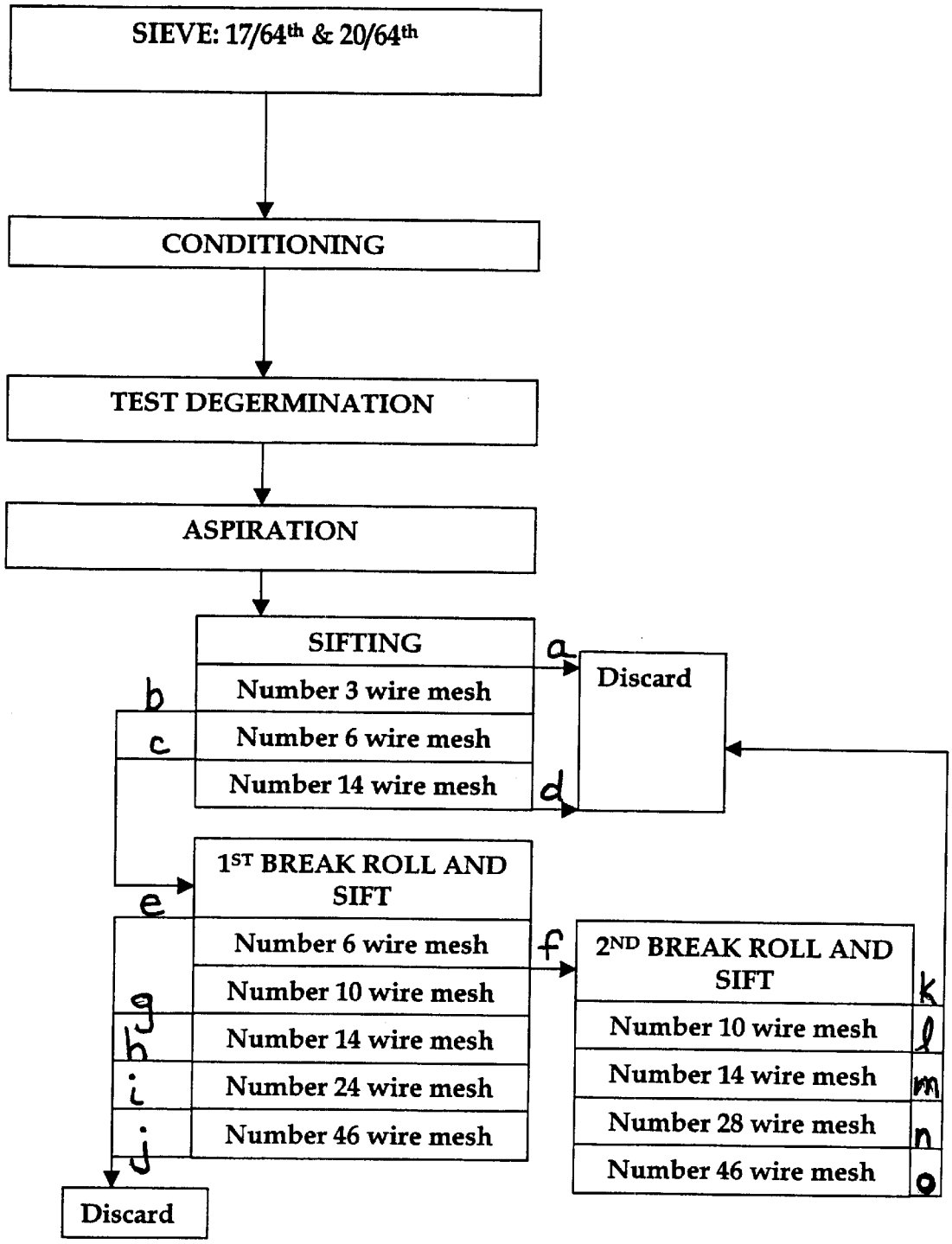
FIG. 4 is a flow chart that demonstrates a second test mill protocol for a second embodiment of the invention.
Figure 5:
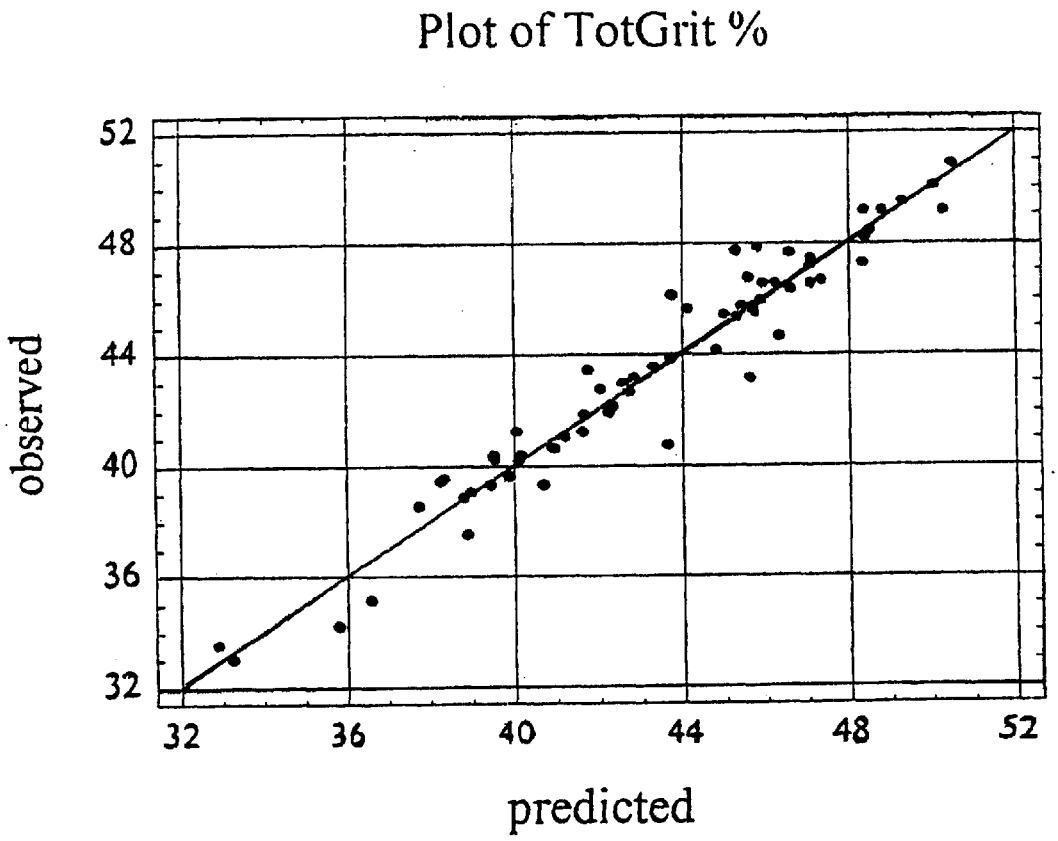
FIG. 5 is a plot of observed and predicted Total Grit Extraction % in accordance with Equation 2, which equation utilizes data collected under the protocol of FIG. 2.
Figure 7:
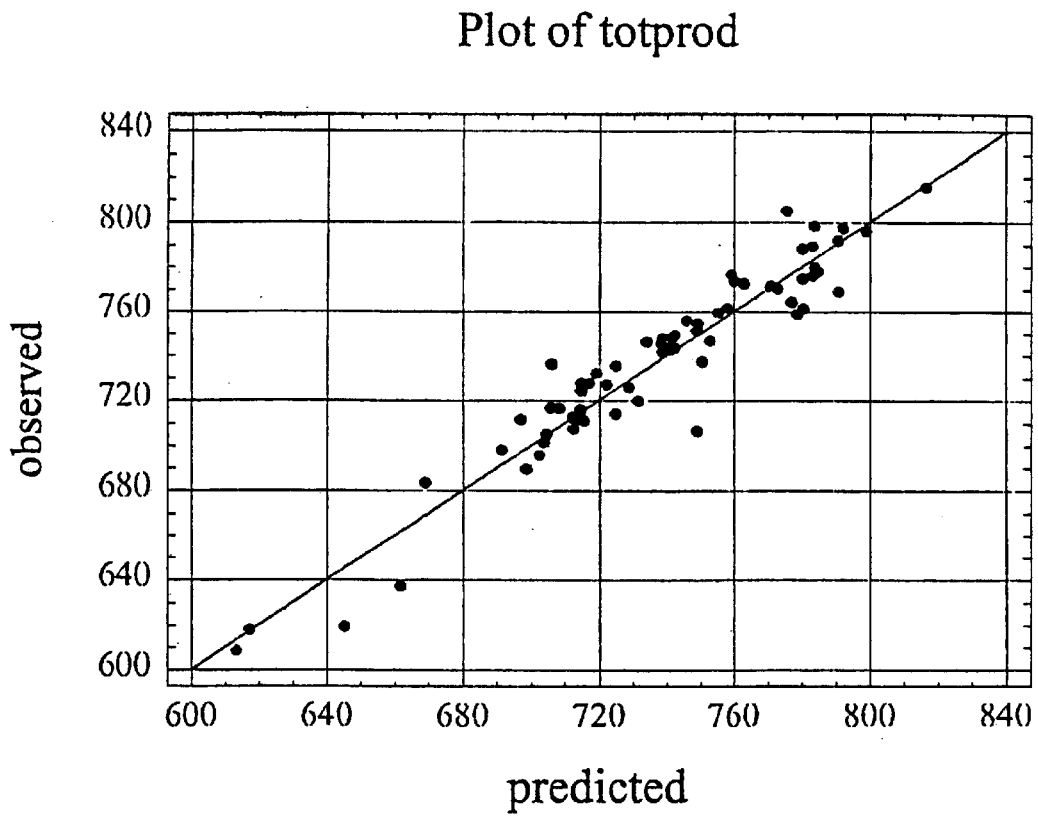
FIG. 7 is a plot of observed and predicted Total Yield % in accordance with Equation 3, which equation utilizes data collected under the protocol of FIG. 3.

FIG. 4 represents a second embodiment of the present invention that relates to a "shortened" bench-scale test mill protocol. This second embodiment is a shortened protocol based on the elimination of steps from the long protocol if those steps were not necessary to generate the data required to apply Equations 2 or 3. The protocol outlined in FIG. 4 is therefore a short test mill protocol that capitalizes on the results of successful modeling of grit extraction percentage and total yield from the test of the longer protocol.

In accordance with FIG. 4, initial process steps as applied in the long-protocol test are followed. Differences are introduced as those fractions of the product sample that previously were directed to the $1^{st}$ RB, the $3^{rd}$ Break Roller, and the 4th Break Roller are now simply discarded after they have been weighed and their weights have been recorded. For example, in the long protocol fraction g is taken from the $1^{st}$ Break Roll sifter and directed towards the 4th Break Roller. In the shortened protocol fraction g is simply discarded. Similarly, fractions k and l are simply discarded rather than being directed towards a $1^{st}$ RB and a $3^{rd}$ Break Roller respectively. The second embodiment as illustrated in FIG. 4 therefore eliminates 3 of 5 roller steps and the pre-rolling aspiration and post-rolling sifting that accompany these steps. In the process, a smaller amount of data capable of accurately predicting grit extraction and product yield data is obtained in approximately half of the time required to perform the long protocol test.

Tables 12–16 below illustrate data collected under the shortened bench scale protocol of the second embodiment (FIG. 4). Tables 12–16 will be understood with reference to the discussion of tables 1–11 herein. It is additionally noted that Table 12 includes initial (i.e. pre-conditioning) moisture content data for each sample.

TABLE 12

INITIAL SAMPLE

| Test | (−17) Breakage | Ave. Moist | +20 | −20/+17 |
|---|---|---|---|---|
| 1 | 93.7 | 13.1 | 612.7 | 251.3 |
| 1 | 94 | 13.8 | 593.7 | 307.6 |
| 1 | 90 | 13.6 | 632.8 | 267 |
| 1 | 91.4 | 13.6 | 609.7 | 273.9 |
| 2 | 89.5 | 13 | 592.7 | 265.5 |
| 1 | 94.8 | 13.5 | 629.7 | 301.3 |

TABLE 13

HOMINY GRADER

| Test | +3 (a) | +6 (b) | +14 (c) | −14 (d) |
|---|---|---|---|---|
| 1 | 28.8 | 618.5 | 261.7 | 45.5 |
| 1 | 20.3 | 589.4 | 270.7 | 58 |
| 1 | 111.1 | 544.6 | 277.8 | 19.5 |
| 1 | 88.8 | 547.9 | 296.8 | 20.2 |

TABLE 13-continued

HOMINY GRADER

| Test | +3 (a) | +6 (b) | +14 (c) | −14 (d) |
|---|---|---|---|---|
| 2 | 57.8 | 526.1 | 327.1 | 30.4 |
| 1 | 98.3 | 553.2 | 279.1 | 25.8 |

TABLE 14

1st BREAK

| Test | +6 (e) | +10 (f) | +14 (g) | +24 (h) | +46 (i) | −46 (j) |
|---|---|---|---|---|---|---|
| 1 | 58.4 | 418 | 243.1 | 109.5 | 20.8 | 24.7 |
| 1 | 117.9 | 437.5 | 177.7 | 77.5 | 18 | 22.6 |
| 1 | 93.7 | 407.2 | 188.9 | 93.6 | 16 | 19.1 |
| 1 | 82.1 | 410.5 | 208.6 | 100.1 | 16.9 | 20.4 |
| 2 | 116.7 | 435.9 | 167.4 | 90.8 | 16.2 | 19.9 |
| 1 | 114.9 | 404.7 | 172.9 | 93.9 | 18.3 | 23.5 |

TABLE 15

2nd BREAK

| Test | +10 (k) | +14 (l) | +28 (m) | +46 (n) | 46 (o) |
|---|---|---|---|---|---|
| 1 | 48.9 | 104.4 | 227.1 | 18.4 | 17.3 |
| 1 | 67.6 | 118 | 208.5 | 18.7 | 19.8 |
| 1 | 64.5 | 124.7 | 185.8 | 15 | 14.4 |
| 1 | 57.2 | 116.7 | 202.5 | 16 | 15.3 |
| 2 | 69.1 | 111.3 | 210.6 | 19.5 | 20.6 |
| 1 | 78.5 | 121.4 | 168.3 | 15.4 | 16.8 |

TABLE 16

1RB

| Test | +7 (p) | +10 (q) | +16 (r) | +28 (s) | +46 (t) | −46 (u) |
|---|---|---|---|---|---|---|
| 1 | 12.8 | 48.6 | 32 | 9.9 | 1.9 | 2.1 |
| 1 | 33 | 73.1 | 51.9 | 16.8 | 3.8 | 3.9 |
| 1 | 29.3 | 62.2 | 45.7 | 14.2 | 2.8 | 3 |
| 1 | 26.6 | 56 | 38.1 | 12.6 | 2.7 | 2.5 |
| 2 | 30 | 73.5 | 52.6 | 19.3 | 4.3 | 4.4 |
| 1 | 29.3 | 74.4 | 56.2 | 22.9 | 4.3 | 5 |

Table 17, below, illustrates results obtained through the application of the data in Tables 12–16 to Equations 2 and 3 (Total Grits % and Total Product) respectively. Total Yield is simply the total input sample divided by the Total Product. Therefore, whereas Total Product is reported herein as grams, Total Yield is expressed in grams of input per grams of product. Table 18 represents the application of the millability rating analysis to the Total Yield and Total Grits extraction percentages obtained via application of Equations 2 and 3.

TABLE 17

| Test | Total Grits % | Total Product (grams) | Total Yield (grams input/grams produced) |
|---|---|---|---|
| 1 | 47% | 830 | 1.20 |
| 1 | 44% | 756 | 1.32 |

TABLE 17-continued

| Test | Total Grits % | Total Product (grams) | Total Yield (grams input/grams produced) |
|---|---|---|---|
| 1 | 42% | 764 | 1.31 |
| 1 | 44% | 787 | 1.27 |
| 2 | 43% | 782 | 1.28 |
| 1 | 39% | 760 | 1.32 |

TABLE 18

| Test | Grit % Rating | Yield Rating 0–7 | Millability Rating 0–7 |
|---|---|---|---|
| 1 | 3.00 | 7.00 | 5 |
| 1 | 1.00 | 5.00 | 3 |
| 1 | 0.00 | 6.00 | 2 |
| 1 | 1.00 | 7.00 | 3 |
| 2 | 0.00 | 7.00 | 3 |
| 1 | 0.00 | 6.00 | 2 |

Figure 9:
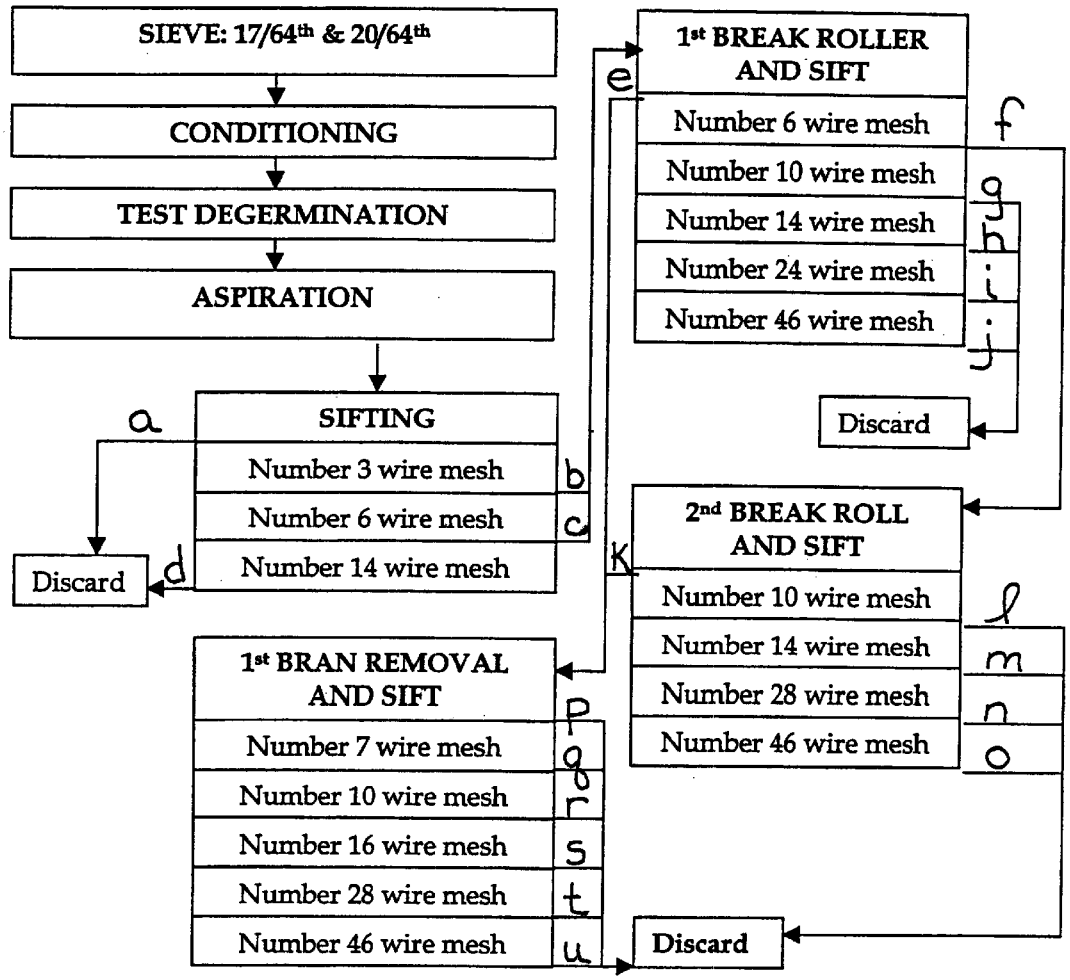
FIG. 9 is a flow chart that demonstrates a third test mill protocol for a third embodiment of the invention.
Figure 10:
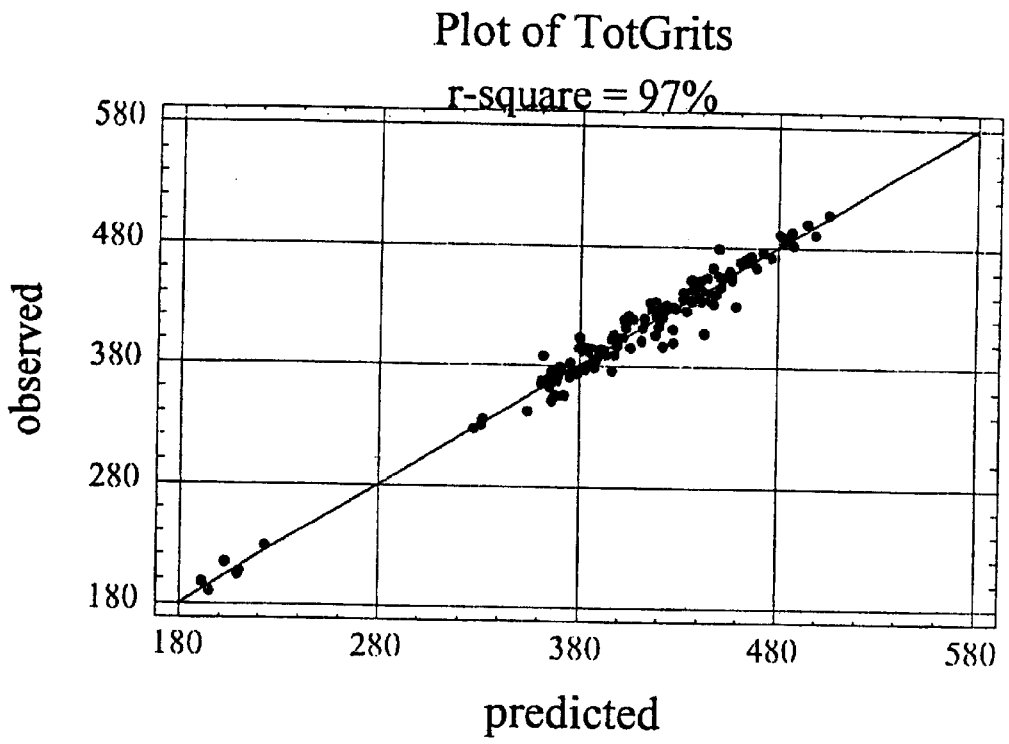
FIG. 10 is a plot of observed and predicted Total Grit Extraction % in accordance with Equation 4, which equation utilizes data collected under the protocol of FIG. 9.
Figure 12:
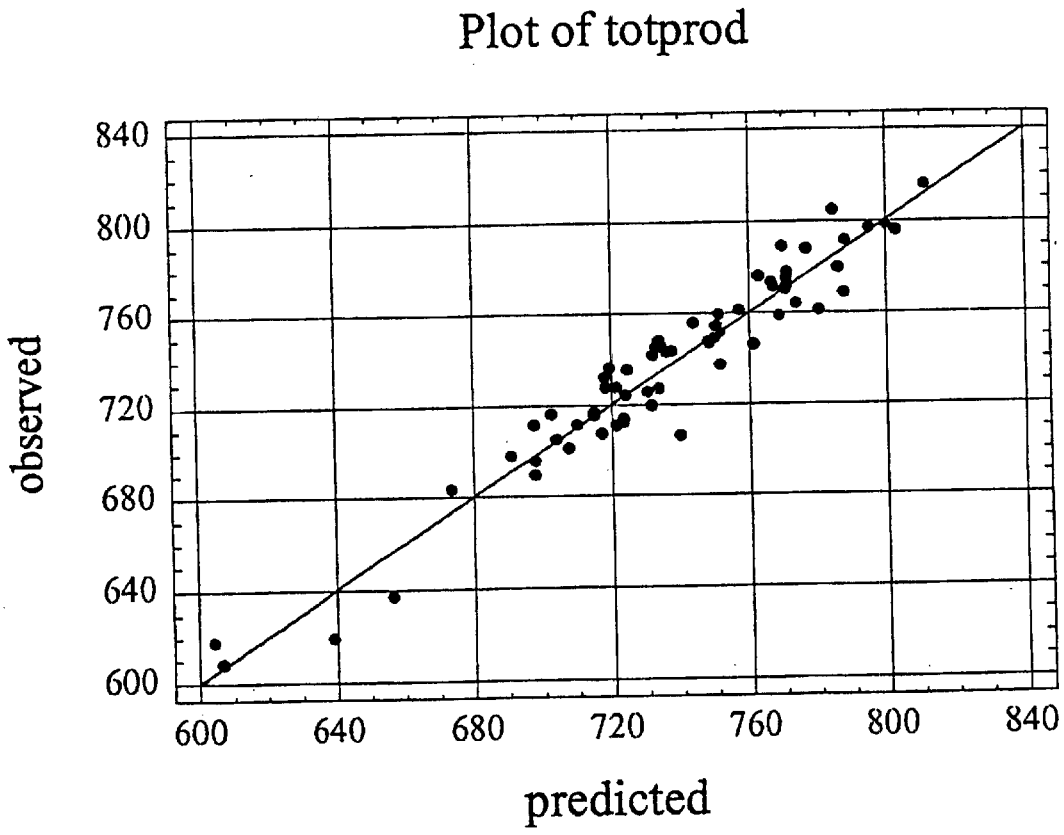
FIG. 12 is a plot of observed and predicted Total Yield % in accordance with Equation 5, which equation utilizes data collected under the protocol of FIG. 9.
Figure 14:
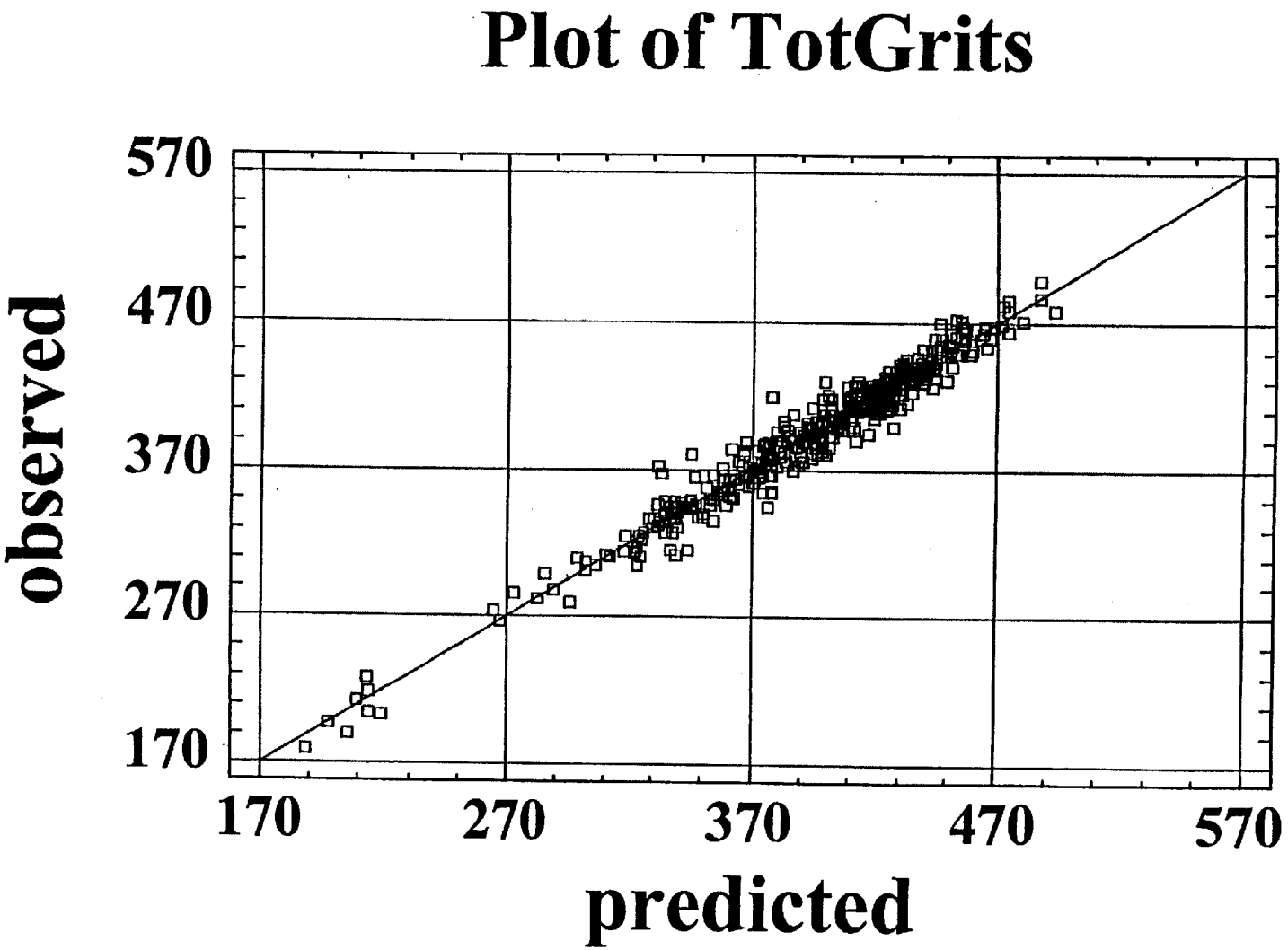
FIG. 14 is a plot of observed and predicted Total Grit Extraction % in accordance with Equation 6, which equation utilizes data collected under the protocol of FIG. 4.
Figure 16:
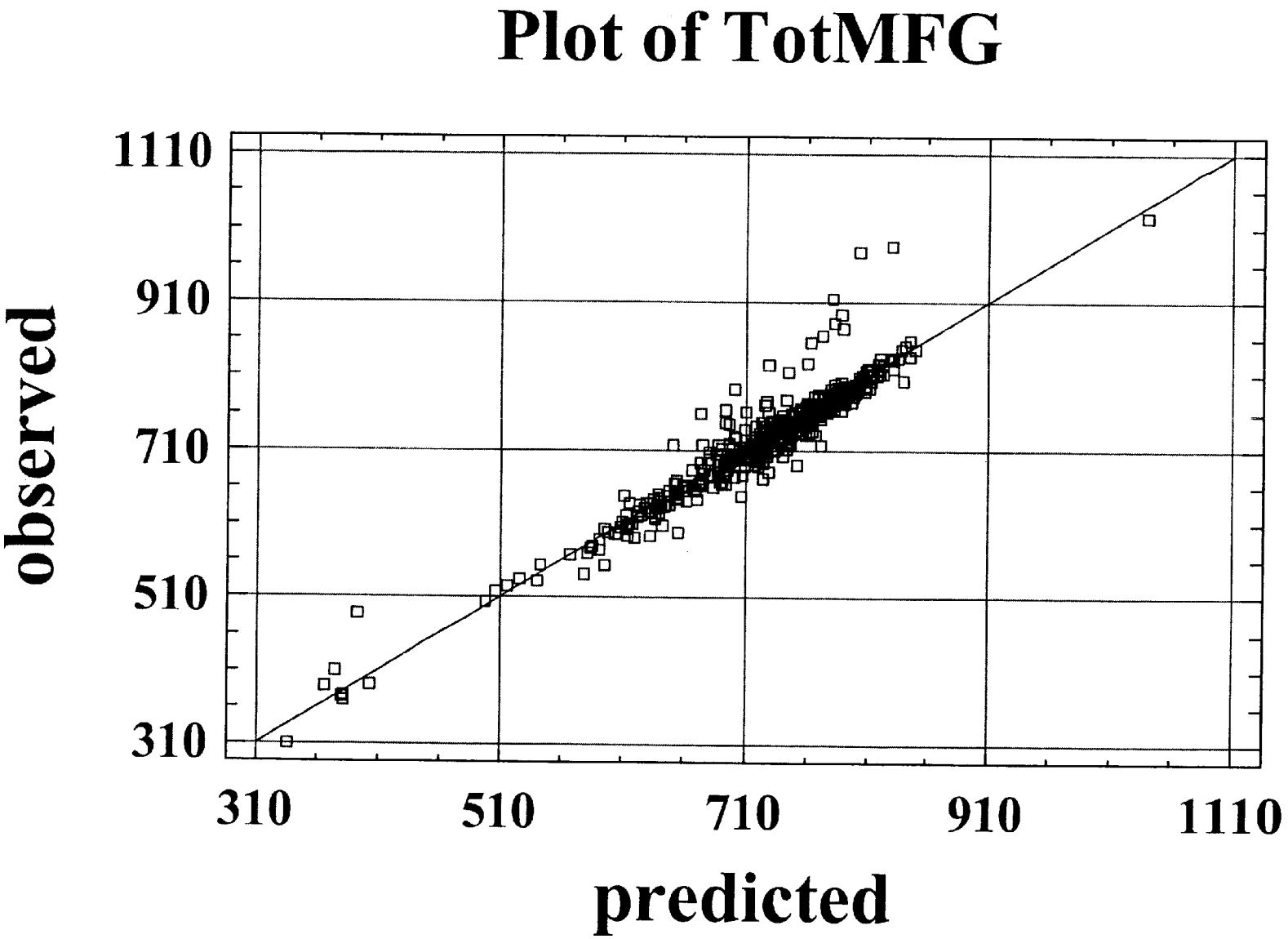
FIG. 16 is a plot of observed and predicted Total Yield % in accordance with Equation 7, which equation utilizes data collected under the protocol of FIG. 4.

In FIG. 9, which represents the third embodiment of the invention, the shortened test milling protocol also includes the 1RB rolling and sifting steps (and the collection of data for fractions p, q, r, s, t, and u). Because Equation 5 utilizes the weight of fraction r as a significant data point, the shortened protocol designed to gather data for use with Equation 5 could not eliminate the 1RB process steps. After collecting data under the protocol of FIG. 9, equations 4 and 5 are employed to determine Total Grit % and Total Product.

The fourth embodiment of the invention again follows the protocol provided in FIG. 4, but utilizes Equations 6 and 7 instead of Equations 2 and 3. In Equation 6, one of the independent variables, "$2^{nd}$ Break Roller Grit Extraction %" is a composite variable that comprises the weight of the grit fraction (m) divided by the total weight of the sample that is fed through the $2^{nd}$ Break Roller (k+l+m+n+o). Therefore, it is demonstrated that independent variables need not be limited to sample fraction weights, but rather, the variables used in the multiple linear regression analysis may themselves be functions of the sample fraction weights.

Of course, full scale milling processes vary depending on the desired finished product specifications and the relative percentages of flour, meal, grits, or other product that is desired. Therefore, it will be understood that the protocols described herein represent preferred embodiments of the testing process invention and are not limiting in scope to the invention which relates generally to the application of a bench scale milling process utilizing a small quantity of grain, and a shortened bench scale milling process. Depending on the full scale mill being simulated and the relative importance of return or "feedback loop" streams in the full scale mill, the long and the shortened protocol tests developed through application of the present invention may or may not include iterative steps. Of course iterative steps will necessarily increase the length of the test protocol.

Once Total Grit Extraction % data, Total Product data, and Millability Ratings are obtained, it will be possible to apply this data to select grain for milling, to determine pricing premiums and discounts to be applied to particular shipments of grain, and to direct hybrid researchers, developers, and breeders in the selection of parents to cross, corn hybrids to develop, and early generation corn hybrids to pursue or to eliminate from future breeding populations. In this manner tremendous savings may be realized in both the milling and the hybrid development industries. In the milling industries, accurate data will be available to predict the milling suitability of grain without the use of production scale milling facility resources and vast quantities of grain to obtain such data. In the hybrid development industries investment in the development of hybrids may be terminated within the first few generations or growing seasons for hybrids having poor millability ratings rather than continuing development of these hybrids all the way to the point of commercial release or the point at which commercial quantities are available.

Having explained the preferred embodiments herein, it will be understood by those of skill in the art that the present invention is well adapted to achieve the objects recited herein including the development of a process to allow the testing and selection of hybrids for desired milling applications based upon a small sample of grain and the development of equations to allow a shortening of testing protocols to eliminate unnecessary steps in the simulation process without sacrificing accuracy. Further, the present invention is well adapted to enable selection of grain for milling based on small samples of the grain. Finally, the small scale testing protocols enable collection of data and effective communication and direction of hybrid breeding programs generations in advance of commercial release of tested hybrids.

It will be evident to those skilled in the art that various revisions can be made to the preferred embodiments described herein without departing from the spirit and scope of the invention. It is my intention, however, that all such revisions and modifications that are evident to those skilled in the art will be included within the scope of the following claims.

What is claimed is:

1. A method for evaluating the milling suitability of a quantity of grain based on a representative sample of said quantity of grain, said method comprising the steps of:

selecting a representative sample of the quantity of grain;

selecting for simulation a plurality of milling steps from a production-scale milling process, thereby establishing a first bench-scale simulation of the production-scale milling process;

milling the representative sample of grain in the first bench-scale simulation;

collecting data to determine the yield or the extraction percentage from said first bench-scale simulation;

utilizing said collected data to determine the milling suitability for the quantity of grain.

2. The method of claim 1 wherein the grain is corn.

3. The method of claim 2 wherein the corn is a pre-commercial hybrid.

4. The method of claim 1 wherein at least one of the selected plurality of milling steps from the production-scale milling process comprises separating at least a portion of the representative sample via size discrimination.

5. The method of claim 4 wherein the step of separating at least a portion of the representative sample via size discrimination comprises sifting the representative sample with a plurality of sieves.

6. The method of claim 1 wherein at least one of the selected plurality of milling steps from the production-scale milling process comprises the step of degerminating the representative sample.

7. The method of claim 1 wherein at least one of the selected plurality of milling steps from the production-scale milling process comprises breaking at least a portion of the representative sample in a roller.

8. The method of claim 1 wherein the production scale milling process comprises the production-scale milling process from an existing production scale mill.

9. The method of claim 1 wherein the collected data from the first bench-scale simulation comprises grain weight data corresponding to output from a plurality of the bench-scale milling process steps.

10. The method of claim 1 further comprising the step of analyzing the collected data to identify bench-scale process steps that contribute at a selected level of significance to the determination of the milling suitability.

11. The method of claim 10 wherein the milling suitability characteristic is bran extraction, grit extraction, meal extraction, flour extraction, germ extraction, or total yield product.

12. The method of claim 10 further comprising the steps of: selecting and milling a second representative sample of grain in a shortened bench-scale milling process wherein said shortened bench-scale milling process eliminates at least one bench-scale milling process step from said first bench-scale simulation.

13. The method of claim 1 wherein the milling suitability is a composite characteristic determined through the weighted combination of two or more items of normalized, collected data.

14. The method of claim 1 wherein the quantity of grain is of a known hybrid.

15. A method for developing varieties of grain suitable for use in a selected milling process comprising the steps of:

selecting a small scale sample of grain for testing;

testing the milling suitability of the sample in a small scale test milling process, said small scale test milling process comprising a simulation of selected steps from a selected production scale milling process;

collecting data from said testing step to determine the yield or the extraction percentage.

* * * * *